US011065866B2

(12) United States Patent
Loginov et al.

(10) Patent No.: US 11,065,866 B2
(45) Date of Patent: Jul. 20, 2021

(54) APPARATUSES FOR PRODUCING OPTICAL EFFECT LAYERS

(71) Applicant: SICPA HOLDING SA, Prilly (CH)

(72) Inventors: Evgeny Loginov, Renens (CH); Mathieu Schmid, Lausanne (CH); Claude-Alain Despland, Prilly (CH); Pierre Degott, Crissier (CH); Edgar Muller, Lausanne (CH)

(73) Assignee: SICPA HOLDING SA, Prilly (CH)

( * ) Notice: Subject to any disclaimer, the term of this patent is extended or adjusted under 35 U.S.C. 154(b) by 514 days.

(21) Appl. No.: 15/328,823

(22) PCT Filed: Aug. 19, 2015

(86) PCT No.: PCT/EP2015/069048
§ 371 (c)(1),
(2) Date: Jan. 24, 2017

(87) PCT Pub. No.: WO2016/026896
PCT Pub. Date: Feb. 25, 2016

(65) Prior Publication Data

US 2017/0232727 A1 Aug. 17, 2017

(30) Foreign Application Priority Data

Aug. 22, 2014 (EP) ..... 14181939

(51) Int. Cl.
*B41F 19/00* (2006.01)
*B42D 25/29* (2014.01)
(Continued)

(52) U.S. Cl.
CPC ..... *B41F 19/005* (2013.01); *B05D 3/207* (2013.01); *B05D 5/065* (2013.01); *B41F 1/38* (2013.01);
(Continued)

(58) Field of Classification Search
CPC ..... B05D 5/06; B05D 5/061; B05D 5/065; B05D 5/063; B05D 5/066; B05D 5/068;
(Continued)

(56) References Cited

U.S. PATENT DOCUMENTS 2,570,856 A 10/1951 Carlton et al.
3,676,273 A 7/1972 Irving
(Continued)

FOREIGN PATENT DOCUMENTS

CN 101003224 7/2007
CN 102267277 12/2011
(Continued)

OTHER PUBLICATIONS

J.H.E. Promislow et al. (Aggregation kinetics of paramagnetic colloidal particles, J. Chem. Phys., 1995, 102, p. 5492-5498).
(Continued)

*Primary Examiner* — Tabassom Tadayyon Eslami
(74) *Attorney, Agent, or Firm* — Muncy, Geissler, Olds & Lowe, P.C.

(57) ABSTRACT

The apparatus and methods of the present disclosure relate to devices comprising spinning magnets driven by electric motors for use with printing or coating equipment. These devices and methods are for orienting magnetic or magnetisable pigment particles in an unhardened coating composition on a substrate. Specifically, these devices and methods are for producing optical effect layers. The apparatus comprises a holder, onto which is mounted a motor and a permanent magnet assembly. The motor is configured to spin the permanent magnet assembly. The holder is configured to be removably fixed to a base of a rotating magnetic cylinder (RMC) or a flatbed printing unit.

16 Claims, 14 Drawing Sheets

(51) Int. Cl.

| | |
|---|---|
| ***B41M 3/14*** | (2006.01) |
| ***H01F 7/02*** | (2006.01) |
| ***B41F 15/22*** | (2006.01) |
| ***B41F 13/18*** | (2006.01) |
| ***B41F 13/10*** | (2006.01) |
| ***B41F 1/38*** | (2006.01) |
| ***B41F 15/24*** | (2006.01) |
| ***B05D 3/00*** | (2006.01) |
| ***B05D 5/06*** | (2006.01) |

(52) U.S. Cl.
CPC ..... *B41F 13/10* (2013.01); *B41F 13/18* (2013.01); *B41F 15/22* (2013.01); *B41F 15/24* (2013.01); *B41M 3/14* (2013.01); *H01F 7/0247* (2013.01); *H01F 7/0294* (2013.01)

(58) Field of Classification Search
CPC .... B42D 25/29; B42D 25/369; B42D 25/378; B42D 25/45; B41F 19/005; B41F 19/00; B41M 3/14; H01F 41/16; B41D 25/29
See application file for complete search history.

(56) References Cited

U.S. PATENT DOCUMENTS

| | | | | |
|---|---|---|---|---|
| 3,791,864 | A | 2/1974 | Steingroever | |
| 5,364,689 | A | 11/1994 | Kashiwagi et al. | |
| 5,630,877 | A | 5/1997 | Kashiwagi et al. | |
| 5,671,671 | A | 9/1997 | Wyssmann et al. | |
| 2007/0172261 | A1* | 7/2007 | Raksha ..... | B05D 3/207 399/266 |
| 2013/0029112 | A1* | 1/2013 | Bargir ..... | B42D 25/369 428/195.1 |

FOREIGN PATENT DOCUMENTS

| | | |
|---|---|---|
| CN | 102529326 | 7/2012 |
| EP | 0406667 | 1/1995 |
| EP | 0710508 | 5/1996 |
| EP | 0723864 | 7/1996 |
| EP | 0556449 | 3/1997 |
| EP | 2433798 | 3/2012 |
| JP | 576125 | 1/1982 |
| JP | 0566327 | 9/1993 |
| JP | 2003168256 | 6/2003 |
| JP | 3734347 | 1/2006 |
| JP | 2008181622 | 8/2008 |
| KR | 1997076654 | 12/1997 |
| WO | 2161816 | 5/1996 |
| WO | 1997029912 | 8/1997 |
| WO | 2002090002 | 11/2002 |
| WO | 2004007095 | 1/2004 |
| WO | 2004007096 | 1/2004 |
| WO | 2004096545 | 11/2004 |
| WO | 2005002866 | 1/2005 |
| WO | 2005095109 | 10/2005 |
| WO | 2008046702 | 4/2008 |
| WO | 2008102303 | 8/2008 |
| WO | 2010066838 | 6/2010 |
| WO | 2012038531 | 3/2012 |
| WO | 2014108404 | 7/2014 |

OTHER PUBLICATIONS

E. Climent et al. (Dynamics of self-assembled chaining in magnetorheological fluids, Langmuir, 2004, 20, p. 507-513).
B. Asian et al. IECON'11, Atralia (2011).
"Mechanisms and Mechanical Devices Sourcebook" (Neil Sclater, McGraw-Hill, 5th Edition, p. 311-317).
International Search Report and Written Opinion issued with respect to application No. PCT/EP2015/069048.
Chinese Office Action in counterpart Chinese Application No. CN201580042790.2 dated Oct. 24, 2019 (and English language translation of the Office Action).

* cited by examiner

Texas Instruments DRV10866 motor controller

APPARATUSES FOR PRODUCING OPTICAL EFFECT LAYERS

FIELD OF THE INVENTION

The present invention relates to the field of the protection of value documents and value commercial goods against counterfeit and illegal reproduction. In particular, the present invention relates to devices comprising spinning magnets driven by electric motors for use with printing or coating equipments, for orienting magnetic or magnetizable pigment particles in an unhardened coating composition on a substrate, as well as to methods for producing optical effect layers (OEL).

BACKGROUND OF THE INVENTION

It is known in the art to use inks, coating compositions, coatings, or layers, containing magnetic or magnetizable pigment particles, particularly also optically variable magnetic or magnetizable pigment particles, for the production of security elements, e.g. in the field of security documents. Coatings or layers comprising oriented magnetic or magnetizable pigment particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in specific optical effects, useful for the protection of security documents, have been disclosed in WO 2002/090002 A2 and WO 2005/002866 A1.

Security features, e.g. for security documents, can generally be classified into "covert" security features and "overt" security features. The protection provided by "covert" security features relies on the concept that such features require specialized equipment and knowledge for detection, whereas "overt" security features rely on the concept of being detectable with the unaided human senses, e.g. such features may be visible and/or detectable via the tactile senses while still being difficult to produce and/or to copy. However, the effectiveness of overt security features depends to a great extent on their recognition as a security feature, because users will only then actually perform a security check based on said security feature if they have actual knowledge of its existence and nature.

Magnetic or magnetizable pigment particles in printing inks or coatings allow for the production of optical effect layers (OEL), comprising a magnetically induced image, design or pattern which is obtained through the application of a corresponding magnetic field, causing a local orientation of the magnetic or magnetizable pigment particles in the not yet hardened coating, followed by hardening the coating. The result is a permanently fixed magnetically induced image, design or pattern. Materials and technologies for the orientation of magnetic or magnetizable pigment particles in coating compositions by applying external magnetic fields as can be produced with external permanent magnets or energized electromagnets have been disclosed in U.S. Pat. Nos. 3,676,273; 3,791,864; EP 406,667 B1; EP 556,449 B1; EP 710,508 A1; WO 2004/007095 A2; WO 2004/007096 A2; WO 2005/002866 A1; as well as in WO 2008/046702 A1 and other documents; therein the applied external magnetic field remains essentially static with respect to the OEL during the orientation step. In such a way, magnetically induced images, designs and patterns which are highly resistant to counterfeit can be produced. Such security elements can only be produced by someone having access to both, the magnetic or magnetizable pigment particles or the corresponding ink, and the particular technology employed to print said ink and to orient said pigment in the printed ink.

The magnetic orientation patterns obtained or obtainable with static magnetic fields can be approximately predicted from the geometry of the magnet arrangement, through a simulation of the three-dimensional magnetic field line pattern.

By applying an external magnetic field, a magnetic pigment particle is oriented such that its magnetic axis is aligned with the direction of the external magnetic field line at the location of the pigment particle. A magnetizable pigment particle is oriented by the external magnetic field such that the direction of its longest dimension is aligned with a magnetic field line at the location of the pigment particle. Once the magnetic or magnetizable pigment particles are aligned, the coating composition is hardened, and the aligned magnetic or magnetizable pigment particles are herewith fixed in their positions and orientations.

Highly useful, dynamic and aesthetically appealing security features based on magnetically induced images, designs or patterns providing the optical illusion of movement can be obtained by a dynamic interaction of a time-varying external magnetic field with magnetic or magnetizable pigment particles in an unhardened coating composition. In this process the magnetic or magnetizable pigment particle adopts a position and an orientation of lowest hydrodynamic resistance when interacting with the surrounding medium. A detailed description of the involved mechanism was given by J. H. E. Promislow et al. (Aggregation kinetics of paramagnetic colloidal particles, *J. Chem. Phys.,* 1995, 102, p. 5492-5498) and by E. Climent et al. (Dynamics of self-assembled chaining in magnetorheological fluids, *Langmuir,* 2004, 20, p. 507-513).

With the aim of producing coatings or layers comprising dynamically oriented magnetic or magnetizable pigment particles, methods for generating time-variable magnetic fields of sufficient intensity have been developed.

US 2007/0172261 A1 discloses a magnetic orientation device comprising spinning magnets driven by gears and shafts within the body of a rotating cylinder of a printing or coating equipment. However, US 2007/0172261 is silent on the type of motor or driving means necessary to set the spinning magnets into rotation.

CN 102529326 A discloses a magnetic orientation device comprising a drive device and a magnet, the drive device driving the magnet to rotate around a rotation shaft and the magnetic field produced by the rotating magnet being used for magnetically orienting magnetic or magnetizable pigment particles in a magnetic ink printed on a substrate such as to form a magnetically oriented pattern with a three-dimensional appearance. However, the disclosed drive device is designed for a belt-driven flatbed printing unit in a discontinuous printing process.

The co-pending European patent applications 13150693.3 and 13150694.1 disclose OELs exhibiting rotationally symmetric visual effects that may be obtained by static or dynamic (e.g. spinning) magnet assemblies.

There still remains a need for a modular, easily replaceable apparatus that fits into an existing rotating magnetic cylinder of a printing or coating equipment, or into a flatbed printing unit, and which is capable of generating a rotating magnetic field of any desired shape so as to provide a great variety of optical effects through the magnetic orientation of pigment particles in a coating by time-varying magnetic fields.

SUMMARY OF THE INVENTION

In a first aspect of the present invention, and as depicted in FIG. 1 and FIG. 2, there is provided an apparatus for producing an optical effect layer comprising:

a holder (1*a*, 1*b*), the holder having mounted thereto:

a motor (2*a*, 2*b*+2*c*), preferably an electric motor; and a permanent magnet assembly (PMA) (6);

wherein the motor (2*a*, 2*b*+2*c*) is configured to spin the permanent magnet assembly (PMA) (6), and wherein the holder (1*a*, 1*b*) is configured to be removeably fixed to a base of a rotating magnetic cylinder (RMC) or a flatbed printing unit.

The holder (1*a*, 1*b*) and one or more parts mounted thereto are able to be removed from the base and replaced by an alternative holder (1*a*, 1*b*) that is able to be removeably fixed to the base in the same way. The holder (1*a*, 1*b*) has mounted thereto rotatable parts that may be prone to failure thus requiring exchange. Also, it may be, it be desirable to quickly change the holder (1*a*, 1*b*) and/or the parts mounted thereto to produce alternative optical effect layers (OEL). In an embodiment, the permanent magnet assembly (PMA) (6) may be removeably fixed to the holder (1*a*, 1*b*) to allow for replacement. The removeable fixation of the permanent magnet assembly (PMA) (6) to the holder (1*a*, 1*b*) may be a releasable coupling to allow for easy replacement. The removeable coupling of the permanent magnet assembly (PMA) (6) to the holder (1*a*, 1*b*) may also removeably couple the permanent magnet assembly (PMA) (6) to at least part of the motor (2*a*, 2*b*+2*c*), thereby leaving the at least part of the motor (2*a*, 2*b*+2*c*) in place in the holder (1*a*, 1*b*) when the permanent magnet assembly (PMA) (6) is removed.

In an embodiment of the present invention, the apparatus may comprise a support (3*a*, 3*b*). The support (3*a*, 3*b*) is configured to be removeably fixed to the holder (1*a*, 1*b*) and comprises a cavity within which the permanent magnet assembly (PMA) (6) spins by action of the motor (2*a*, 2*b*+2*c*), said motor (2*a*, 2*b*+2*c*) being configured to spin the permanent magnet assembly (6) within the cavity. According to this embodiment, the support (3*a*, 3*b*) and the permanent magnet assembly (PMA) (6) are removeable from the holder (1*a*, 1*b*) as a module and the holder (1*a*, 1*b*) including at least part of the motor (2*a*, 2*b*+2*c*) mounted thereto is removeable from the rotating magnetic cylinder (RMC) or flatbed printing unit as a module. This allows for convenient replacement of the module comprising the support (3*a*, 3*b*) and the spinning permanent magnet assembly (PMA) (6) including rotating parts of the apparatus, which may be liable to failure and thus need replacing.

In an embodiment, the support (3*a*, 3*b*) is able to be removed from the holder (1*a*, 1*b*) to allow for replacement of the spinning permanent magnet assembly (PMA) (6) with an alternative support (3*a*', 3*b*') that is able to be removeably fixed to the holder (1*a*, 1*b*) in the same way. The alternative support (3*a*', 3*b*') also has an alternative spinning permanent magnet assembly (PMA)(6') disposed within a cavity of the alternative support (3*a*', 3*b*') and is configured to be spun therein by the motor (2*a*, 2*b*+2*c*).

The apparatuses described herein are each configured for aggregately orienting magnetic or magnetizable pigment particles in a coating on a substrate by way of a rotating magnetic field produced by the spinning permanent magnet assembly (PMA) (6) to thereby produce an optical effect layer (OEL).

A system may be provided comprising at least one of the apparatuses described herein and the rotating magnetic cylinder (RMC) or the flatbed printing unit.

In an embodiment, the rotating magnetic cylinder (RMC) or the flatbed printing unit comprises a plurality, in particular an array, of the apparatuses described herein, each apparatus comprising the motor (2*a*, 2*b*+2*c*), the permanent magnet assembly (PMA) (6), the holder (1*a*, 1*b*) and the optional support (3*a*, 3*b*), in order to produce, at the same time, a plurality, in particular an array, of optical effect layers (OEL), by applying a rotating magnetic field produced by the spinning permanent magnet assembly (PMA) (6) to aggregately orient the magnetic or magnetizable pigment particles.

The rotating magnetic cylinder (RMC) may comprise, as a base, a circumferential mounting groove into which one or more, or a plurality, of the apparatuses according to the first aspect are fixed such as to be distributed circumferentially. The rotating magnetic cylinder (RMC) may additionally or alternatively comprise, as a base, a plurality of circumferential mounting grooves distributed along the length of the rotating magnetic cylinder (RMC), each mounting groove having one or more, or a plurality, of the apparatuses of the first aspect mounted therein. One or more fasteners may be provided for removeably fixing the apparatus of the present invention to the one or more circumferential mounting grooves. An exemplary rotating magnetic cylinder (RMC) to which the apparatus of the present invention can be mounted is described in WO 2008/102303 A2.

In the case of a flatbed printing unit, the base is formed as one or more mounting recesses to which one or more apparatuses of the first aspect are removeably fixed. A plurality of such mounting recesses may be provided laterally and/or longitudinally with respect to the printing direction, each having an apparatus according to the first aspect mounted or fixed therein. One or more fasteners may be provided for removeably fixing the one or more apparatuses of the invention described herein to the mounting recesses of the flatbed printing unit.

In an embodiment of the first aspect, the holder (1*a*, 1*b*) is configured to be removeably fixed to a base of a rotating magnetic cylinder (RMC) or a flatbed printing unit. The base may be according to that described above. The holder (1*a*, 1*b*) can thus be easily changed on the rotating magnetic cylinder (RMC) or the flatbed printing unit to configure the rotating magnetic cylinder (RMC) for producing alternative optical effect layers (OEL).

In an embodiment, the removeable fixation of the holder (1*a*, 1*b*) to the base of the rotating magnetic cylinder (RMC) or the flatbed printing unit is a releasable coupling, such as a threaded screw. In an embodiment, the apparatus comprises one or more fasteners for removeably fixing the holder (1*a*, 1*b*) to the base.

In an embodiment, the apparatus is configured to provide a first partial surface for supporting a substrate, directly or indirectly, thereon when the apparatus is removeably fixed to the rotating magnetic cylinder (RMC) or the flatbed printing unit. The first partial surface may be smooth. The first partial support surface may be the top surface of the apparatus, which is closest to the substrate.

In an embodiment, the rotating magnetic cylinder (RMC) or the flatbed printing unit provides a second partial support surface and one or more of the apparatuses are removeably fixed to the rotating magnetic cylinder (RMC) or the flatbed printing unit to be flush with the second partial support surface to together define a complete support surface. The complete support surface may have a planar or a cylindrical shape. The substrate carrying the coating comprising magnetic or magnetizable pigment particles as described above may be directly or indirectly disposed on the complete support surface.

In one implementation, the second partial support is a cover plate which may be disposed around the rotating magnetic cylinder (RMC) for directly supporting the substrate, said cover plate being provided with openings corresponding to the location of each of the apparatuses. Alternatively, the cover plate may provide the complete support surface, thus covering each of the apparatuses of the invention described herein. In this case, the cover plate is made of a material having no magnetic permeability or having a low magnetic permeability.

The apparatus described herein provides a smooth surface for supporting a substrate, directly or indirectly (e.g. via a cover plate as mentioned above), carrying a coating composition comprising magnetic or magnetizable pigment particles upon which a rotating magnetic field generated by the spinning permanent magnet assembly (PMA) (6) acts to aggregately orient the magnetic or magnetizable pigment particles to produce an optical effect. In an embodiment comprising the support (3*a*, 3*b*), the support includes a lid (8) providing the smooth surface.

The apparatus or each of the apparatuses is/are arranged on the rotating magnetic cylinder (RMC) or the flatbed printing unit and include a first support surface to define in combination with a second support surface of the rotating magnetic cylinder (RMC) or of the flatbed printing unit a combined support surface that conforms to an outer surface having a planar or a cylindrical shape. A cover plate as mentioned hereabove may be disposed on the combined support surface and the substrate may be directly supported on the cover plate.

In a related feature, but a feature which is additionally applicable to the apparatus per se (i.e. not necessarily included as part of a rotating magnetic cylinder (RMC)), the apparatus has a first support surface that is curved to match the curvature of a second support surface of the rotating magnetic cylinder (RMC) to which the apparatus is removeably fixed. The first support surface may be the top surface of the apparatus, which is closest to the substrate.

In an embodiment comprising a support (3*a*, 3*b*), the holder (1*a*, 1*b*) forms a first partial support surface and the support (3*a*, 3*b*), when removeably fixed to the holder (1*a*, 1*b*), forms a second partial support surface and the first and second partial support surfaces are flush with one another for supporting the substrate thereon, either directly or indirectly. The first and second partial support surfaces may provide a combined top surface of the apparatus, which is closest to the substrate.

In an embodiment comprising a support (3*a*, 3*b*), the support (3*a*, 3*b*) is provided in a flat form with respect to (i.e. along) the rotational axis of the spinning permanent magnet assembly (PMA) (6). The support may have a generally rectangular (including square) shape when viewed from above with respect to a rotational axis of the spinning permanent magnet assembly (PMA) (6).

In an embodiment, the support (3*a*, 3*b*) has an enclosure surrounding the cavity on all sides, e.g. the support (3*a*, 3*b*) encloses the cavity on all sides along the rotation axis of the permanent magnet assembly (PMA) (6) and perpendicular thereto.

In an embodiment, the support (3*a*, 3*b*) comprises a circumferential wall defining an outer periphery of the cavity, wherein the permanent magnet assembly (PMA) (6) has an outer circumference fitting the circumferential wall of the support (3*a*, 3*b*) such as to provide for a thin air layer therebetween.

In an embodiment, the holder (1*a*, 1*b*) has a recess into which the support (3*a*, 3*b*) is fittingly positioned when it is removeably fixed thereto. The recess is surrounded by two or more sidewalls. Preferably, the recess is a pocket surrounded by four, or alternatively by two opposed sidewalls.

In an embodiment, the removeable fixation is such as to hold the support (3*a*, 3*b*) fixed to the holder (1*a*, 1*b*) along a rotation axis of the spinning permanent magnet assembly (PMA) (6) and in directions perpendicular thereto. That is, the support (3*a*, 3*b*) is immovable when the removeable fixation is tightened. In an embodiment, the removeable fixation comprises one or more couplers or fasteners that are moveable between a first position in which the support (3*a*, 3*b*) is fixed to the holder (1*a*, 1*b*) with respect to a rotation axis of the spinning permanent magnet assembly (PMA) (6) and a second position in which the support (3*a*, 3*b*) is able to be removed from the holder (1*a*, 1*b*) by moving it along the rotation axis of the spinning permanent magnet assembly (PMA) (6).

In an embodiment, the apparatus comprises one or more releasable couplers or fasteners for fixing the support (3*a*, 3*b*) to the holder (1*a*, 1*b*), said fasteners being optionally releasable by operation of a tool, such as a rotatable tool. Alternatively, the fixation of the support (3*a*, 3*b*) to the holder (1*a*, 1*b*) may comprise threaded screws, latch fasteners or the like. In an embodiment, the fastener is provided as a cam element that is moveable between a projecting position in which the support is secured to the holder (1*a*, 1*b*) and a position in which the support (3*a*, 3*b*) is free to be removed from the holder (1*a*, 1*b*). The cam element may be moved between positions by use of a rotating tool.

In an embodiment, access is provided to one or more threaded screws or other fixation elements when the support (3*a*, 3*b*) is removed from the holder (1*a*, 1*b*), the threaded screws or other coupling elements for securing the holder (1*a*, 1*b*) to part of a printing machine, e.g. a base of rotating magnetic cylinder (RMC) or a flatbed printing unit as described above. In an embodiment, access is provided to one or more fixation elements for removeably fixing the holder (1*a*, 1*b*) to a base of a rotating magnetic cylinder (RMC) or a flatbed printing unit by a hole extending through the center of at least part of the motor (2*a*, 2*b*+2*c*). The access may be for a specific tool that cooperates with the one or more fixation elements to allow the fixation to be undone using that specific tool.

In embodiments comprising a support (3*a*, 3*b*), the support (3*a*, 3*b*) preferably has a height dimension along a rotation axis of the permanent magnet assembly (PMA) (6) of less than 30 mm, preferably less than 20 mm, and more preferably 15 mm or less.

In an embodiment, the permanent magnet assembly (PMA) (6) is removeably coupled to the motor (2*a*) by a rotation transmission shaft. In an embodiment, the rotation transmission shaft may be part of a magnet holder (5*a*) that holds the permanent magnet assembly (PMA) (6). The support (3*a*) is able to be removed from the holder (1*a*) and the permanent magnet assembly (PMA) (6) is able to be removed from the motor (2*a*) as the support (3*a*) is removed from the holder (1*a*) by way of the removeable fixations. That is, the support (3*a*) and the permanent magnet assembly (PMA) (6) are held together so that they are removed from the holder (1*a*) and the motor (2*a*) as one. The permanent magnet assembly (PMA) (6) is able to be removed from the motor (2*a*) as the support (3*a*) is removed due to the permanent magnet assembly (PMA) (6) being held within the support.

In an embodiment, the transmission shaft couples the permanent magnet assembly (PMA) (6) and the rotor part of the electric motor (2*a*), at least in part, through complementary shaft and recess. The complementary shaft and recess may have complementary, non-circular cross-sections to allow for torque transmission.

In an embodiment, the motor (2*a*) comprises a rotor part and a stator part, wherein the rotor part further comprises a recess, and the permanent magnet assembly (PMA) (6) is removeably coupleable to the recess via a shaft.

In an embodiment, the removeable coupling of the spinning permanent magnet assembly (PMA) to the rotor of the electric motor (2*a*) is formed by a claw and spring coupling mechanism, or a ball and spring coupling mechanism, or a friction type coupling mechanism to ensure a proper torque transmission.

In an embodiment, the motor (2*a*) is a flat electric motor. That is, a stator part and a rotor part of the motor are dimensioned to have a smaller height dimension along a rotation axis than a diameter or other maximum cross-sectional dimension perpendicular to the height.

In an embodiment, the motor (2*a*) has a thickness dimension along a rotation axis of less than 20 mm, preferably less than 15 mm, more preferably less than 10 mm, and even more preferably of 7 mm or less.

In an embodiment of the first aspect, the motor comprises a rotor part (2*c*) and a stator part (2*b*), and wherein the rotor part (2*c*) is disposed within a cavity of the support (3*b*) and the stator part (2*b*) is located external of the support and electromagnetically coupled to the rotor part (2*c*) to induce rotation in the rotor part (2*c*). The support (3*b*) is removeably fixed to the holder (1*b*), thereby allowing both rotatable parts to be easily replaced, including the rotor part (2*c*) and the spinning permanent magnet assembly (PMA) (6).

In an embodiment, a ring shaped element (7) is disposed between the permanent magnet assembly (PMA) (6) and the rotor part (2*c*) of the electric motor. The ring shaped element (7) is configured to disturb or interact with a magnetic field produced by the rotor (2*c*) so as to concentrate said magnetic field and/or reduce or minimize magnetic interference with the permanent magnet assembly (PMA) (6).

In embodiments of the first aspect comprising a support (3*a*, 3*b*), the permanent magnet assembly (PMA) (6) may be fixed to the support (3*a*, 3*b*) by a bearing (4), preferably a ball bearing, to allow for easy relative rotation therebetween. In an embodiment, the bearing (4) is disposed inside the support (3*a*, 3*b*). In an embodiment, the bearing (4) is included in the cavity of the support (3*a*, 3*b*). In an embodiment, the support (3*a*, 3*b*) comprises a hub about which a bearing (4) is mounted to rotationally couple the support (3*a*, 3*b*) and the permanent magnet assembly (PMA) (6).

In an embodiment, the bearing (4) includes inner and outer races and rolling elements therebetween. Preferably, the bearing (4) is made of non-magnetic materials, such as made of austenitic steel races with ceramic (e.g. silicon carbide or silicon nitride) balls. More preferably, the rolling elements are made of non-electrically-conducting and non-magnetic materials.

In a preferred embodiment, the bearing (4) is a Conrad-type bearing.

In an embodiment, the support (3*a*, 3*b*) is removeable from the holder (1*a*, 1*b*) so that the bearing (4) is removed with the support by way of it being coupled thereto. The bearing (4) is a fatigue prone component that may need to be replaced. The bearing may also be prone to other types of mechanical and/or corrosion failure.

In an embodiment, the support (3*a*, 3*b*) including the bearing (4) and the permanent magnet assembly (PMA) (6) is a module removeable from the holder (1*a*, 1*b*) as one by operation of the removeable fixation of the support (3*a*, 3*b*) to the holder (1*a*, 1*b*).

In an embodiment, there is provided a magnet holder (5*a*, 5*b*) to which the permanent magnet assembly (PMA) (6) is fixed and the bearing (4) is provided as a separate element coupling the magnet holder (5*a*, 5*b*) to the support (3*a*, 3*b*). The magnet holder (5*a*, 5*b*) may include a recess wherein the permanent magnet assembly (PMA) (6) is disposed. The permanent magnet assembly (PMA) (6) may protrude from the recess. In an embodiment, the magnet holder (5*a*, 5*b*) is substantially disc shaped.

In an embodiment, the permanent magnet assembly (PMA) (6) is disc shaped.

The permanent magnet assembly (PMA) (6) comprises at least one permanent magnet, said permanent magnet assembly (PMA) (6) further comprising at least one magnetizable material. In an embodiment, the at least one magnetizable material comprises one or more soft magnetic materials such as for example iron.

In an embodiment, the apparatus and embodiments thereof is dimensioned to have a height dimension along a rotation axis of the permanent magnet assembly (PMA) (6) of less than 50 mm, preferably less than 40 mm, and more preferably less than 30 mm.

In a second aspect of the invention, there is provided a rotating magnetic cylinder (RMC) comprising one or more apparatuses of the first aspect and embodiments thereof, mounted to the circumferential grooves of the rotating magnetic cylinder (RMC) through the removeable holder (1*a*, 1*b*).

The rotating magnetic cylinder (RMC) is meant to be used in, or in conjunction with, or being part of a printing or coating equipment, and bearing one or more apparatuses of the first aspect, aimed at generating rotating magnetic fields, said rotating magnetic cylinder (RMC) serving to aggregately orient the magnetic or magnetizable particles of the coating composition. In an embodiment of the second aspect, the rotating magnetic cylinder (RMC) is part of a rotary, sheet-fed or web-fed industrial printing press that operates at high printing speed in a continuous way.

In the second aspect, the rotating magnetic cylinder (RMC) comprises a base to which the holder (1*a*, 1*b*) is removeably fixed. The base may be according to that described above, e.g. the base consists of one or more circumferential mounting grooves in the rotating magnetic cylinder (RMC) that fittingly receives the holder (1*a*, 1*b*) and the other components of the apparatus.

The rotating magnetic cylinder (RMC) of the second aspect is arranged such as to convey a substrate carrying a coating comprising magnetic or magnetizable pigment particles and the spinning permanent magnet assembly (PMA) (6) of the apparatus is configured to apply a rotating magnetic field to aggregately orient the magnetic or magnetizable pigment particles of the coating composition to produce optical effect layers (OEL).

In a third aspect of the invention, there is provided a flatbed printing unit comprising one or more apparatuses of the first aspect and embodiments thereof, mounted to the recesses of the flatbed printing unit through the removeable holder (1*a*, 1*b*).

The flatbed printing unit is meant to be used in, or in conjunction with, or being part of a printing or coating equipment, and bearing one or more apparatuses of the first aspect, aimed at generating rotating magnetic fields to aggregately orient the magnetic or magnetizable particles of the coating composition. In a preferred embodiment of the third aspect, the flatbed printing unit is part of a sheet-fed industrial printing press that operates in a discontinuous way.

A system comprising the rotating magnetic cylinder (RMC) of the second aspect or the flatbed printing unit of the third aspect may include a substrate feeder for feeding a substrate having thereon a coating of magnetic or magnetizable pigment particles, so that the spinning permanent magnet assembly (PMA) (6) generates a rotating magnetic field that acts on the pigment particles to orient them aggregately to form an optical effect layer (OEL).

In an embodiment of the system comprising a rotating magnetic cylinder according to the second aspect, the substrate is fed by the substrate feeder under the form of sheets or a web. In an embodiment of the system comprising a flatbed printing unit according to the third aspect, the substrate is fed under the form of sheets.

A system comprising the rotating magnetic cylinder (RMC) of the second aspect or the flatbed printing unit of the third aspect may include a printer for applying a coating on a substrate, the coating comprising magnetic or magnetizable pigment particles that are aggregately oriented by the rotating magnetic field generated by the spinning permanent magnet assembly (PMA)(6) to form an optical effect layer (OEL).

In an embodiment of the system comprising a rotating magnetic cylinder (RMC) of the second aspect, the printing unit works according to a rotary, continuous process. In an embodiment of the system comprising a flatbed printing unit according to the third aspect, the printing unit works according to a longitudinal, discontinuous process.

A system comprising the rotating magnetic cylinder (RMC) of the second aspect or the flatbed printing unit of the third aspect may include a coating hardener for hardening a coating comprising magnetic or magnetizable pigment particles that have been magnetically oriented aggregately by the spinning permanent magnet assembly (PMA) (6), thereby fixing the orientation and position of the magnetic or magnetizable pigment particles to produce an optical effect layer (OEL).

In a fourth aspect of the present invention, there is provided a method of making an optical effect layer (OEL) on a substrate, the method comprising: providing a substrate carrying a coating composition comprising magnetic or magnetizable pigment particles;

providing an apparatus according to the invention described herein, spinning the permanent magnet assembly (PMA) (6) with the motor (2*a*, 2*b*+2*c*) to produce a rotating magnetic field that is applied to the magnetic or magnetizable pigment particles;

orientating the magnetic or magnetizable pigment particles with the rotating magnetic field to produce the optical effect layer (OEL).

In an embodiment of the fourth aspect, the coating composition is hardened either during the orientation of the magnetic or magnetizable pigment particles or thereafter, so as to fix the magnetic or magnetizable pigment particles in a substantially oriented state or oriented state.

In an embodiment, the method comprises making a value item, including a currency note such as a banknote, a security document, a security label, a product comprising a security label, a value good such as a medical preparation, a alcoholic beverage, so that the value item includes the optical effect layer (OEL).

In a fifth aspect of the invention described herein, there is provided a method of modifying an existing rotating magnetic cylinder (RMC) or flatbed printing unit having non-spinneable permanent magnet assemblies (PMA), the method comprising removing one or more non-spinneable permanent magnet assemblies (PMA) from the rotating cylinder or flatbed printing unit and replacing them with one or more spinneable permanent magnet assemblies (PMA) (6), wherein the one or more spinneable permanent magnet assemblies (PMA) (6) are removeably fixed to the rotating magnetic cylinder (RMC) or to the flatbed printing unit.

In an embodiment, the method comprises removeably fixing the apparatus described herein and any of the embodiments thereof by removeably fixing the holder (1*a*, 1*b*) to the rotating magnetic cylinder (RMC) or the flatbed printing unit. In an embodiment, the apparatus comprising the holder (1*a*, 1*b*) and the spinning permanent magnet assembly (PMA) (6) is designed to be of the same size and shape as the non-spinneable permanent magnet assembly (PMA), so as to occupy the same space in the rotating magnetic cylinder (RMC) or the flatbed printing unit.

In an embodiment of the fifth aspect, there is provided a method of maintaining or modifying a rotating magnetic cylinder (RMC) or flatbed printing unit described herein and any of the embodiments thereof. In an embodiment, the method comprises removing the permanent magnet assembly (PMA) (6) by way of undoing the removeable fixation between the holder (1*a*, 1*b*) and the permanent magnet assembly (PMA) (6) and replacing the removed permanent magnet assembly (PMA) (6) with another permanent magnet assembly (PMA) (6').

In an embodiment of the fifth aspect where the apparatus described herein comprises a support, the method comprises removing the support (3*a*, 3*b*) and the associated permanent magnet assembly (PMA) (6) by undoing the removeable fixation between the holder (1*a*, 1*b*) and the support (3*a*, 3*b*) and replacing the removed support (3*a*, 3*b*) and permanent magnet assembly (PMA) (6) with an alternative support (3*a*', 3*b*') and permanent magnet assembly (PMA) (6'). The alternative support (3*a*', 3*b*') and permanent magnet assembly (PMA) (6') may have the exact same size and shape as the replaced one. The method may alternatively or additionally comprise removing the holder (1*a*, 1*b*) from the rotating magnetic cylinder (RMC) or the flatbed printing unit by undoing the removeable fixation between the holder (1*a*, 1*b*) and the rotating magnetic cylinder (RMC) or the flatbed printing unit and replacing the removed component with an alternative holder (1*a*', 1*b*'). The removed holder (1*a*, 1*b*) and the alternative holder (1*a*', 1*b*') may have mounted thereto at least part of the motor (2*a*, 2*b*+2*c*). The removed (1*a*, 1*b*) and alternative holders (1*a*', 1*b*') may have the same size and shape. Removing the holder (1*a*, 1*b*) may first require the permanent magnet assembly (PMA) (6) and the support (3*a*, 3*b*) to be removed to thereby provide access to one or more removeable fixation elements that removeably fix the holder (1*a*, 1*b*) on the rotating magnetic cylinder (RMC) or the flatbed printing unit.

In a sixth aspect of the invention, there is provided a method for protecting a security item, such as a banknote, comprising the steps of:

i) applying a coating composition comprising magnetic or magnetizable pigment particles to a substrate;

ii) exposing the coating composition to a rotating magnetic field produced by spinning the permanent magnet assembly (PMA) (6) with the motor (2*a*, 2*b*+2*c*) according to the apparatus described herein to orient at least part of the magnetic or magnetizable pigment particles;

iii) hardening the coating composition so as to fix at least part of the magnetic or magnetizable pigment particles in a substantially oriented state or oriented state.

DETAILED DESCRIPTION

Definitions

Figure 1:
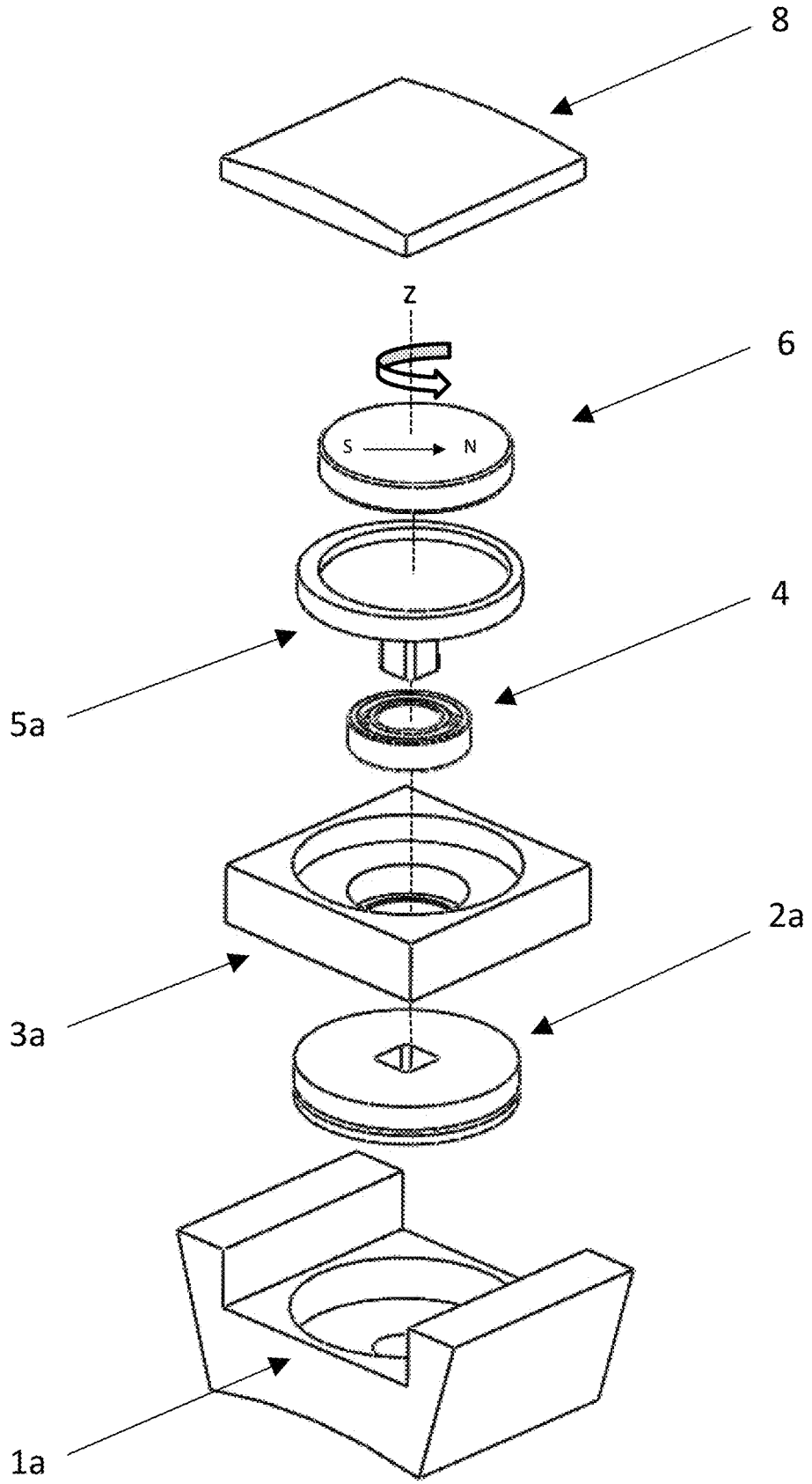
FIG. 1 schematically illustrates an apparatus comprising a holder (1*a*), an electric motor (2*a*) integrated in the holder (1*a*), a support (3*a*) with a cylindrical cavity, the cavity being configured to accomodate a bearing (4), a magnet holder (5*a*) and a permanent magnet assembly (PMA) (6). The rotor part of the electric motor (2*a*) has a recess in its center, and the magnet holder (5*a*) has a shaft that removeably fits into the recess of the rotor part. The apparatus is closed with a fixed magnet block lid (8) or a fixed magnetic plate, optionally a fixed engraved magnetic plate as described in WO 2005/002866 A1. The z-axis is indicated for illustrative purpose.

The following definitions clarify the meaning of the terms used in the description and in the claims.

As used herein, the indefinite article "a" indicates one as well as more than one and does not necessarily limit its referent noun to the singular.

As used herein, the term "about" means that the amount, value or limit in question may be the specific value designated or some other value in its neighborhood. Generally, the term "about" denoting a certain value is intended to denote a range within ±5% of the value. For example, the phrase "about 100" denotes a range of 100±5, i.e. the range from 95 to 105. Generally, when the term "about" is used, it can be expected that similar results or effects according to the invention can be obtained within a range of ±5% of the indicated value. However, a specific amount, value or limit supplemented with the term "about" is intended herein to disclose as well the very amount, value or limit as such, i.e. without the "about" supplement.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "comprising" as used herein is intended to be non-exclusive and open-ended. Thus, for instance a coating composition comprising a compound A may include other compounds besides A. However, the term "comprising" also covers, as a particular embodiment thereof, the more restrictive meanings of "consisting essentially of" and "consisting of", so that for instance "a coating composition comprising a compound A" may also (essentially) consist of the compound A.

The term "aggregately" is used to indicate that, upon the influence of an external magnetic field, a sufficient number of magnetic or magnetizable pigment particles of the wet and not yet hardened composition are oriented along a field line at the same time in order to establish a visual effect. Preferably, this sufficient number is around 1000 or more pigment particles being oriented along said field line at the same time. More preferably, this sufficient number is around 10000 or more pigment particles being oriented along said field line at the same time.

As used herein, the term "wet coating" means an applied coating, which is not yet hardened, for example a coating in which the contained magnetic or magnetizable pigment particles are still able to change their positions and orientations under the influence of external forces acting upon them.

The term "coating composition" refers to any composition which is capable of forming a coating, such as an optical effect layer on a solid substrate and which can be applied e.g. by a printing method.

The term "optical effect layer (OEL)" as used herein denotes a layer that comprises oriented magnetic or magnetizable pigment particles and a binder, wherein the orientation and position of the magnetic or magnetizable pigment particles are oriented by a magnetic field, then subsequently, simultaneously or partially simultaneously fixed in their orientation and position through hardening. The term "optical effect layer" (OEL) refers either to the layer comprising the oriented magnetic or magnetizable pigment particles (i.e. after the orientation step) or to the layer comprising the oriented magnetic or magnetizable pigment particles frozen in their orientation and position (i.e. after the hardening step).

The term "magnetic axis" or "South-North axis" denotes a theoretical line connecting the South and the North pole of a magnet and extending through them. These terms do not include any specific direction. Conversely, the term "South-North direction" and S→N on the figures denote the direction along the magnetic axis from the South pole to the North pole.

The term "spin", "spinning" or "spinneable" refers to the rotation of the spinning permanent magnet assembly (PMA) described herein, regardless of its rotation frequency.

The term "substantially parallel" refers to deviating not more than 20° from parallel alignment and the term "substantially perpendicular" refers to deviating not more than 20° from perpendicular alignment.

The term "security element" or "security feature" is used to denote an image or graphic element that can be used for authentication purposes. The security element or security feature can be overt and/or covert.

DETAILED DESCRIPTION OF THE INVENTION

The present invention concerns particular apparatuses for making OELs with the help of spinning permanent magnet assemblies (PMA) (6). The apparatuses described herein are suitable to be used in, or in conjunction with, or to be part of a printing or coating equipment. In particular the apparatuses described herein may be comprised in a rotating magnetic cylinder (RMC) of a sheetfed or webfed printing or coating equipment used for orienting magnetic or magnetizable pigment particles in a coating composition applied to a substrate, or in a flatbed printing unit with the same aim.

A used herein, the term "rotating magnetic cylinder" (RMC) refers to the part of a high-speed continuous printing press that serves to magnetically orient the magnetic or magnetizable pigment particles, thus producing an optical effect layer (OEL).

According to one embodiment depicted in FIG. 1, the apparatus of the invention comprises a holder (1*a*), a motor (2*a*) and a support (3*a*) configured to be removeably fixed to the holder (1*a*), a magnet holder (5*a*) and a permanent magnet assembly (PMA) (6). Spinneable coupling between the permanent magnet assembly (PMA) (6) and the motor (2*a*) is achieved through a shaft or any mechanical coupling mean known to somebody skilled in the art, the shaft removeably connecting the magnet holder (5*a*) and the motor (2*a*) to set the permanent magnet assembly (PMA) (6) into spinning.

As used herein, "stator part" and "stator" may be used indiscriminately to describe the same technical element. This also applies to "rotor part" and "rotor".

Figure 2:
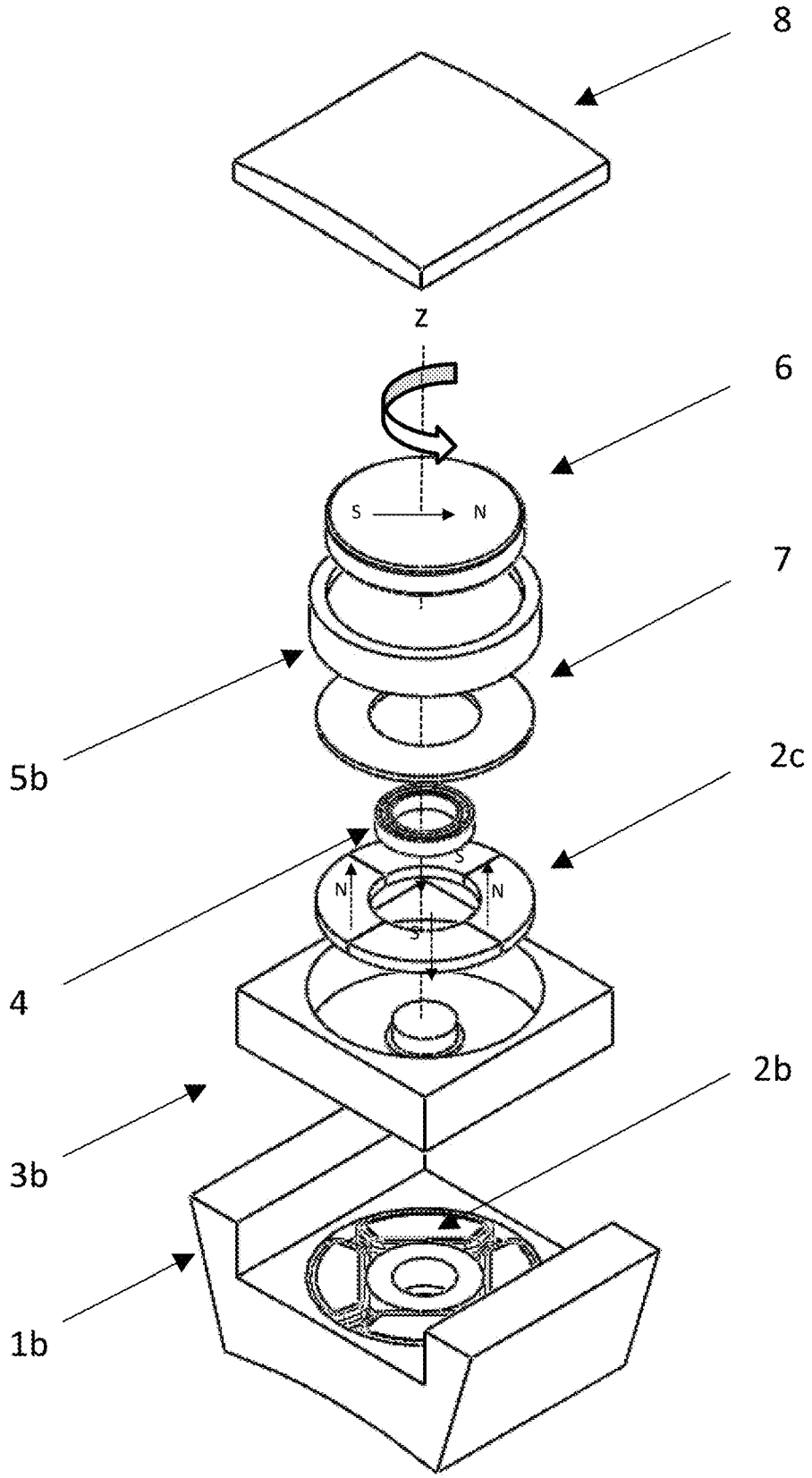
FIG. 2 schematically illustrates an apparatus comprising a holder (1*b*), an electric motor composed of a stator part (2*b*) and a rotor part (2*c*), the stator part (2*b*) being disposed in the holder (1*b*), a support (3*b*) which comprises a cylindrical cavity, the cavity being configured to accommodate the rotor part (2*c*) of the electric motor, a bearing (4), a magnetizable ring-shaped element (7), a magnet holder (5*b*) and a permanent magnet assembly (PMA) (6). The apparatus is closed with a fixed magnet block lid (8) or a fixed magnetic plate, optionally a fixed engraved magnetic plate as described in WO 2005/002866 A1. The z-axis is indicated for illustrative purpose.

According to another embodiment depicted in FIG. 2, the apparatus of the invention comprises a holder (1*b*) bearing the stator part (2*b*) of an electric motor, a support (3*b*) configured to be removeably fixed to the holder (1*b*), the support (3*b*) having therein a cylindrical cavity aimed at receiving the rotor part (2*c*) of the electric motor, a magnetizable disc-shaped element (7), a magnet holder (5*b*) and a permanent magnet assembly (PMA) (6).

Figure 10:
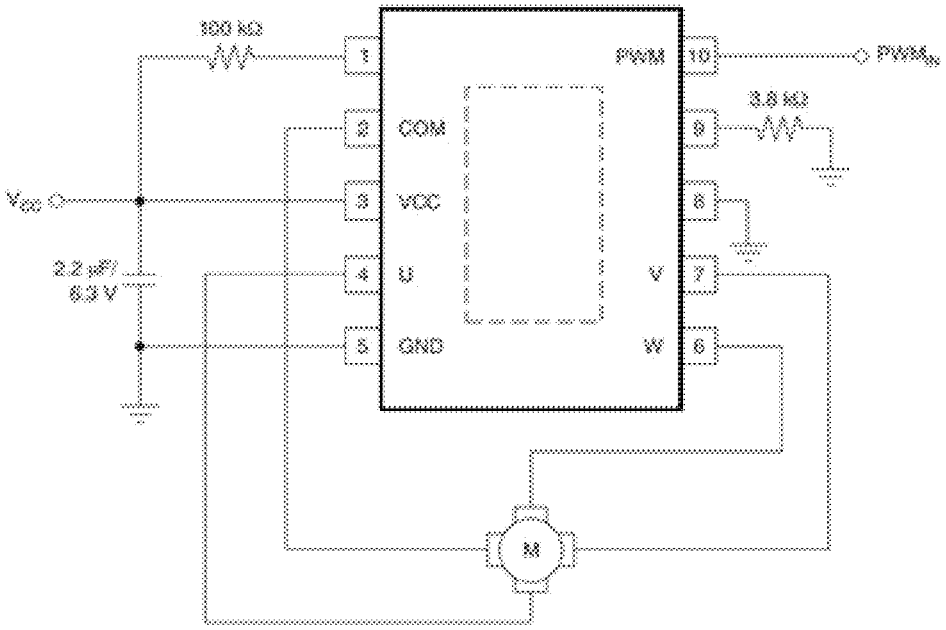
FIG. 10 schematically illustrates the sensorless motor controller used in one of the examples. PWM stands for Pulse Width Modulation (required to set the rotation speed).
Figure 12:
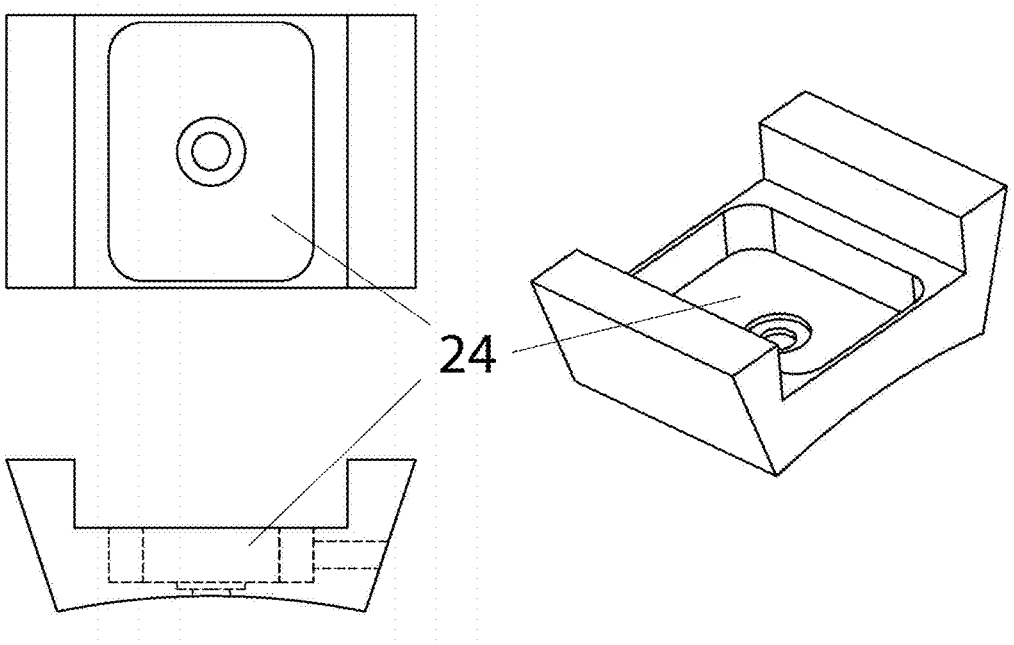
FIG. 12 shows the technical drawing of the holder (1*a*) used in Example 1. The holder (1*a*) comprises a rectangular (including square) cavity (24) aimed at receiving a BLDC disc-shaped motor and the base plate of FIG. 9.
Figure 14:
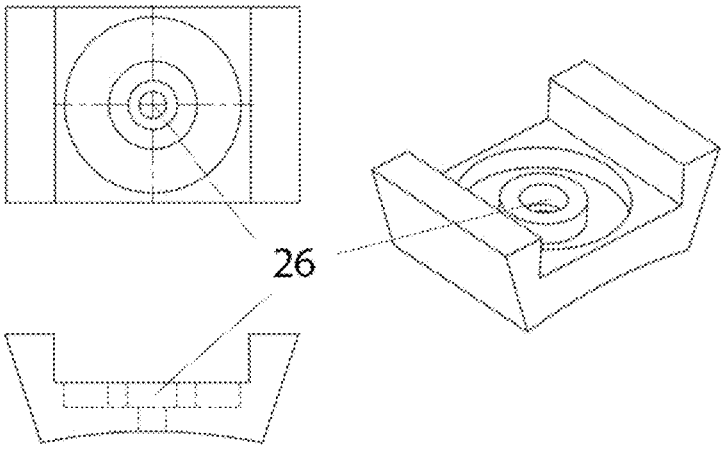
FIG. 14 shows the technical drawing of the holder (1*b*) used in Example 2. The holder (1*b*) comprises a cylindrical cavity (26) aimed at receiving the stator part (2*b*) of a BLDC motor.

According to the embodiments described in FIGS. 1 and 2, the apparatus of the invention comprises a holder (1*a*, 1*b*). The holder (1*a*, 1*b*) is designed at the same time to ensure quick installing or removing of the apparatus of the invention described herein to the mounting circumferential grooves of a rotating magnetic cylinder (RMC) as described in WO 2008/102303 A2 or to the mounting recesses of a flatbed printing unit, and to allow for the easy exchanging of the permanent magnet assembly (PMA) (6) as described herebelow. The holder (1*a*, 1*b*) comprises a recess to fit the support (3*a*, 3*b*), the recess being spatially defined by at least two surrounding sidewalls. Examples are given in FIG. 10 of WO 2008/102303 A2 (four sidewalls), or in FIGS. 12 and 14 (two sidewalls). The fixation system of the holder (1*a*, 1*b*) to the rotating magnetic cylinder (RMC) or the flatbed printing unit may comprise any form of threaded screw or any other form of mechanical fixation. In one embodiment, the holder (1*a*, 1*b*) may be fixed to the rotating magnetic cylinder (RMC) or the flatbed printing unit via a central screw, Allen screw or bolt. In such a case, the electric motor (2*a*) or the stator part of the motor (2*b*) may comprise a central hole sufficiently large to give easy access to the fixation system. The diameter of said hole is preferably between 5 mm and 20 mm, more preferably between 7 mm and 15 mm, even more preferably between 8 mm and 12 mm.

If the apparatus of the invention is part of a rotating magnetic cylinder (RMC), the bottom part of the holder (1*a*, 1*b*) is curved according to the curvature radius of the circumferential mounting groove of the rotating magnetic cylinder (RMC).

Preferably, the holder (1*a*, 1*b*) is made from one or more non-magnetic materials selected from the group consisting of low conducting materials, non-conducting materials and mixtures thereof, such as for example engineering plastics and polymers, titanium, titanium alloys and austenitic steels (i.e. non-magnetic steels). Engineering plastics and polymers include without limitation polyaryletherketones (PAEK) and its derivatives polyetheretherketones (PEEK), poletherketoneketones (PEKK), polyetheretherketoneketones (PEEKK) and polyetherketoneetherketoneketone (PEKEKK); polyacetals, polyamides, polyesters, polyethers, copolyetheresters, polyimides, polyetherimides, high-density polyethylene (HDPE), ultra-high molecular weight polyethylene (UHMWPE), polybutylene terephthalate (PBT), polypropylene, acrylonitrile butadiene styrene (ABS) copolymer, fluorinated and perfluorinated polyethylenes, polystyrenes, polycarbonates, polyphenylenesulfide (PPS) and liquid crystal polymers. Preferred materials are PEEK (polyetheretherketone), POM (polyoxymethylene), PTFE (polytetrafluoroethylene), Nylon® (polyamide) and PPS. Titanium-based materials have the advantage of excellent mechanical stability and low electric conductivity. The holder may however also be of aluminum or aluminum alloys which have the advantage of being easily worked According to the embodiments described in FIGS. 1 and 2, the apparatus described herein comprises a support (3*a*, 3*b*). The support (3*a*, 3*b*) is configured to accommodate the magnet holder (5*a*, 5*b*) bearing the spinning permanent magnet assembly (PMA) (6) or, additionally and as depicted in the embodiment in FIG. 2, the rotor part (2*c*) of the electric motor. The material chosen to build the support (3*a*, 3*b*) may be the same as used for the holder (1*a*, 1*b*), the magnet holder (5*a*, 5*b*) and the casing of the permanent magnet assembly (PMA), or another material selected from the same group.

The fixation system of the support (3*a*, 3*b*) to the holder (1*a*, 1*b*) may comprise any form of releasable threadable fixation or any other form of mechanical fixation. In an embodiment, the support (3*a*, 3*b*) is fixed to the holder (1*a*, 1*b*) through a rotating cam placed vertically into the sidewalls of the holder (1*a*, 1*b*), the rotating cam being rotatable such that the cam surface, when rotated, may fit into a longitudinal notch carved into the side of the support (3*a*, 3*b*). This fixation system ensures a fast exchange of the support (3*a*, 3*b*) comprising the permanent magnet assembly (PMA) (6) as well as a high reliability under working conditions.

Preferably, the motor (2*a*, 2*b*+2*c*) is an electric motor.

Suitable electric motors are either DC (direct current) or AC (alternating current) motors. DC motors can be categorized into brush-type DC motors and brushless DC motors (hereafter referred to as BLDC motors). As used herein, the terms "brushless DC motor" and "BLDC motor" refer to electric motors powered by direct current and possessing a stator bearing magnet-wire coils and a rotor bearing permanent magnets. The current is addressed to the magnet-wire coils in the required sequence through a current control unit (CCU), hence the adjective "brushless". In brush-type DC motors, the rotor carries electric coils which are addressed with current through a mechanical commuter and gliding carbon brush contacts. In brushless DC motors, which are preferred due to the absence of gliding electric contacts, the coils are part of the stator, and the commutation of the electric current in the coils is performed with the help of an electronic circuit.

According to one embodiment, the electric motor described herein is a BLDC motor, said BLDC motors can be subdivided into a) cup- or shell-type BLDC motors, where the rotor is internal and the stator is external, and b) disc-shaped (or "pancake") BLDC motors, where the stator is internal and the rotor is external. There are also switched reluctance motors (hereafter referred to as SR motors). In SR motors, the permanent magnets of the rotor are replaced by poles made of magnetizable material, like pure iron or silicon iron (e.g. electrical steel).

Figure 3:
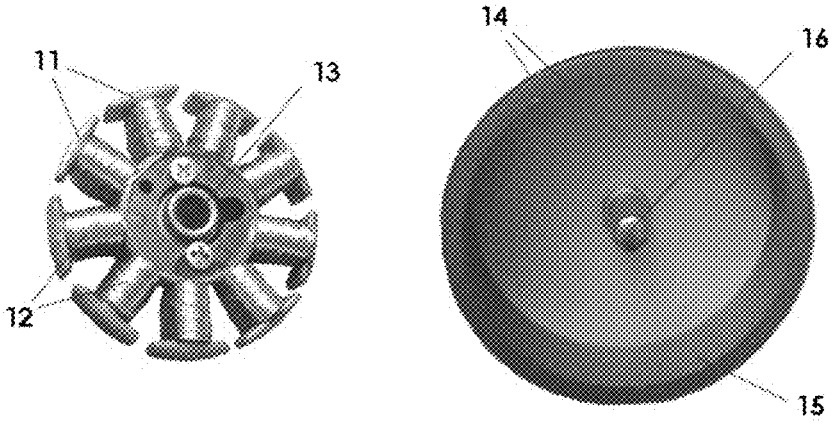
FIG. 3 shows an exploded view of a disc-shaped brushless DC (BLDC) motor.

According to one embodiment, the electric motor described herein is a disc-shaped BLDC motor. Disc-shaped BLDC motors are particularly preferred due to their high torque-to-weight and size ratio. FIG. 3 shows a typical example of such a disc-type BLDC motor. The inner stator comprises an iron core with typically 6 to 18 or more poles (11), the number of poles preferably being a multiple of 3 (corresponding to a 3-phase motor). The poles carry magnet-wire coils (12), which are connected according to a 3-phase scheme. The central part of the iron core comprises a rotational bearing (13). The bell-shaped outer rotor (14) is preferably made of one or more magnetizable materials, preferably iron. The bell-shaped outer rotor carries an inner belt of permanent magnets with alternating poles (15); in the present example a multipole rubber-NdFeB composite magnet. The number of poles on the rotor may be the same as the number of poles on the stator, but preferably a different number of poles is chosen for rotor and stator in order to avoid cogging. Useful combinations of stator coils (SC)/rotor permanent magnets (RM) (referred in the cited literature as slots/poles) for a 3-phase motor include without limitation SC/RM=6/4; 6/8; 6/16; 9/6; 9/8; 9/10; 9/12; 12/8; 12/16; 12/14; 12/16; 15/10; 15/14; 15/16; 18/12; 18/14 and 18/16 (B. Aslan et al. IECON'11, Australia (2011), "Slot/pole combinations choice for concentrated multiphase machines dedicated to mild-hybrid applications").

The rotor also comprises a central axle (16), designed to fit into the rotational bearing (13) of the stator, such that the stator can be located inside the bell-shaped rotor, having a gap distance of the order of 1 mm or less, preferably 0.3 to 1 mm, between the poles (11) of the stator and the multipole magnet (15) of the rotor.

Other embodiments for the BLDC motors are possible, the limitations being the restricted physical space available in the apparatus of the invention described herein and the ability to provide a high torque at low rotation frequency while being smooth and silent in operation.

In the embodiments described in FIG. 1 and FIG. 2, the electric motor (2*a*, 2*b*+2*c*) is driven by a current control unit (CCU). As used herein, the term "current control unit" (CCU) refers to an electronic circuit to address the polyphase, e.g. 3-phase magnet-wire coils of the electric motor (2*a*, 2*b*+2*c*) with electric current in a desired sequence. The current control unit (CCU) may be of any type known in the art.

The current control unit (CCU) may be of a "static" (i.e. fixed frequency) or preferably of a "dynamic" (i.e. adaptive) type. Static CCUs drive the winding assembly with a "rotating" polyphase (in particular triphase) current of fixed frequency. In conjunction with the rotor of the electric motor (2*a*, 2*b*+2*c*), this results in a synchronous motor, which has the tendency of losing synchronization (i.e. "falling off") under load. More elasticity is provided by "dynamic" current control units, which sense the position of the rotor of the electric motor (2*a*, 2*b*+2*c*) and address the winding assembly with electric current accordingly. Such motor resists breaking attempts and starts without problems from stand.

The current control unit (CCU) may comprise a sensor assembly, said sensor assembly being able to sense an attribute of the magnetic field of the rotor of the electric motor (2*a*, 2*b*+2*c*), e.g. its intensity or another indicator of its rotational position. The current control unit (CCU) comprises a controller (e.g. a processor or control circuitry) configured to use the sensed attribute to correspondingly address the winding assembly of the stator of the electric motor (2*a*, 2*b*+2*c*) with electrical current. In a particular embodiment, the controller implements a control loop based on the sensed attribute to control the spinning frequency of the rotor of the electric motor (2*a*, 2*b*+2*c*) at a fixed value. The sensor assembly may comprise one or more sensors.

Preferably, the number of sensors matches the number of phases of the winding assembly. The one or more sensors may be Hall effect sensors.

Figure 5:
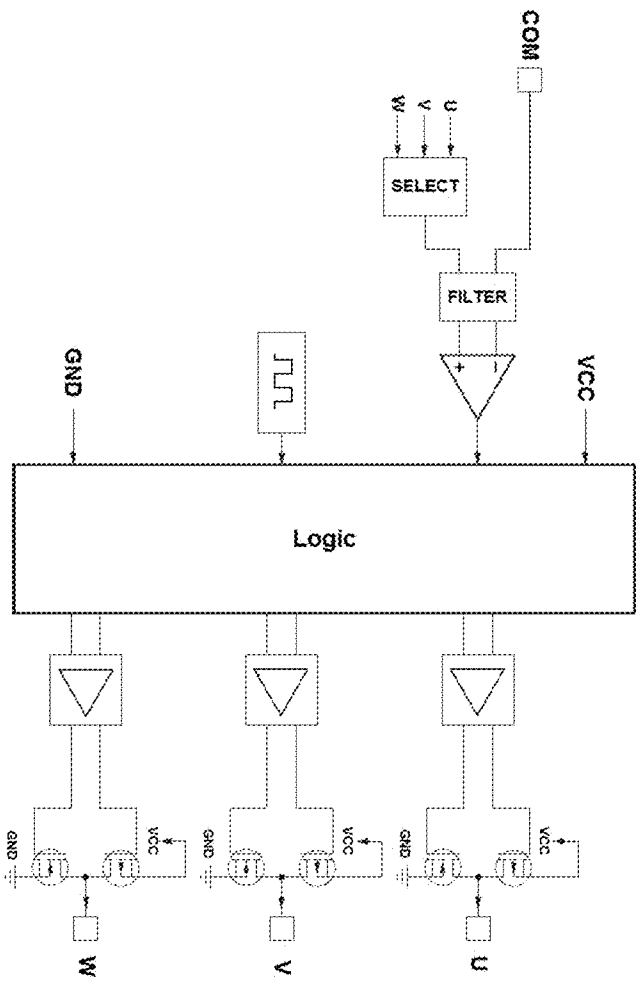
FIG. 5 displays the simplified scheme of a 3-phase sensorless BLDC motor controller. COM, VCC and GND stand for Common, Voltage at Common Collector and Ground, respectively. The three phases are indicated as U, V and W.

In another embodiment, the coils of the winding assembly of the stator of the motor (2*a*, 2*b*+2*c*) may themselves be used as the sensors of the position of the rotor, through an evaluation of the induced voltage produced at them (sensorless motor control via back-EMF). As used herein, the term "back-EMF" refers to the back-electromotive force, or counter-electromotive force which is the voltage induced in the magnet-wire coils of the stator by the spinning rotor. The induced voltage is opposite to the voltage applied by the current control unit (CCU); it progressively counteracts the current flow through the motor at higher spinning frequency. For sensorless motor control a motor in "Star-configuration" is needed. Such motor has 4 connections (U, V, W and Common). Two of the three phases (U, V and W) are addressed with current in the required sense (+ − or − +), and the back-EMF generated between the third phase (W) and the common connector (Com) is measured; it may have a positive, zero, or negative value, depending on the position of the rotor. A controller evaluates the back-EMF and determines thereof the next pair of phases to be addressed and the sense of the electric current. The scheme of such a sensorless motor controller is given in FIG. 5 (GND stands for "ground" and VCC for "voltage at common collector").

The current control unit (CCU) may be configured to apply a phase-shifted alternating current (e.g. sinusoidal) to the magnet-wire coils of the winding assembly or the current control unit (CCU) may be configured to apply a phase-shifted current to the magnet-wire coils of the winding assembly in a square wave form, in a trapezoidal form or in another form. In particular, the current control unit (CCU) may be configured to selectively and sequentially turn on and off the magnet-wire coils and repeat this in sequence to generate a rotating magnetic field.

As shown in FIGS. 1 and 2, the apparatus described herein comprises a spinneable permanent magnet assembly (PMA) (6) able to produce a magnetic field strong enough to change, upon exposure thereto, the orientation of magnetic or magnetizable pigment particles in a wet and not yet hardened coating composition applied to a substrate.

The permanent magnet assembly (PMA) (6) of the apparatus described herein comprises one or more permanent magnets (M1, M2, M3, . . . Mn). When the permanent magnet assembly (PMA) comprises more than one permanent magnets, the South-North direction of each of the permanent magnets (M1, M2, M3, . . . Mn) may be arranged in any relative orientation to each other, and the permanent magnets may be made of the same magnetic material or of different magnetic materials.

When the permanent magnet assembly (PMA) (6) comprises two or more permanent magnets (M1 and M2, M3, . . . Mn), the two or more permanent magnets are preferably disposed in a mechanically symmetric arrangement with respect to the spinning axis such that the permanent magnet assembly is mechanically balanced when spinning. Otherwise, balancing weights made of a non-magnetic material may also be used to allow for a balanced running while spinning the permanent magnet assembly (PMA) (6). On the other hand, the two or more permanent magnets may be magnetically symmetric or magnetically non-symmetric with respect to the spinning axis of the permanent magnet assembly.

Figure 13:
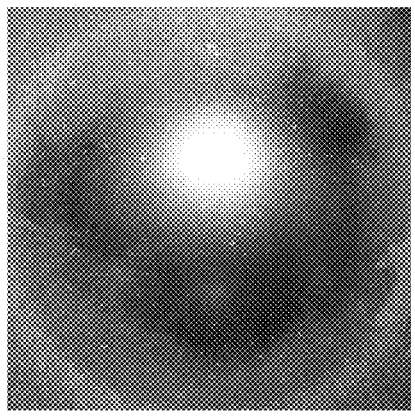
FIG. 13 shows an optical effect layer (OEL) obtained with the apparatus of Example 1.

According to a first preferred embodiment of the permanent magnet assembly (PMA) (6), and as shown in FIGS. 1 and 2, the permanent magnet assembly (PMA) (6) is a disc-shaped dipolar permanent magnet with diametral magnetization, i.e. having its South-North direction substantially parallel to the supporting surface (or the substrate surface, if no supporting surface is used). In this case, the magnetic or magnetizable pigment particles of the wet and not yet hardened composition are aggregately oriented upon spinning of the permanent magnet assembly (PMA) (6), in such a way that their two main axes are substantially parallel to the tangents to a sphere surface. As shown in FIG. 13, the obtained visual effect looks like a portion of a sphere. The permanent magnet assembly (PMA) (6) may take the shape of a disc or of a regular polygon, said disc or polygon optionally comprising a circular or a polygonal hole. Optionally, the circular or polygonal hole may be filled with at least one material selected from the group consisting of non-magnetic materials, magnetizable materials and permanent magnetic materials. In a particular embodiment, the permanent magnet assembly (PMA) (6) has the shape of a circular ring.

According to a second preferred embodiment, the permanent magnet assembly (PMA) (6) is a single bar dipole permanent magnet having its South-North direction substantially parallel to the substrate/support surface. The visual effect is the same as shown in FIG. 13.

Figure 6A:
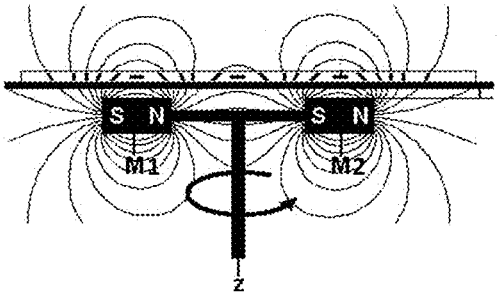
FIGS. 6*a*-6*b* illustrate two embodiments of the spinning permanent magnet assembly (PMA) (6) described herein.

According to a third preferred embodiment, the permanent magnet assembly (PMA) (6) comprises an even or an odd number of n bar dipole permanent magnets (n=1 . . . N, N≤2) aligned such as to correctly balance rotational inertia, their respective South-North direction being substantially parallel to the substrate/support surface. If n is an even number, the South-North direction of the first permanent magnet (n=1) is collinear to the South-North direction of the last permanent magnet (n=N), the South-North direction of the second permanent magnet (n=2) is collinear to the South-North direction of the penultimate permanent magnet (n=N−1), and so on, such that the South-North direction of the $n^{th}$ permanent magnet is collinear to the South-North direction of the $(N-n+1)^{th}$ permanent magnet. If n is an odd number, the South-North direction of the permanent magnet disposed at the rotation axis (or, in other words, at the $(N+1)/2^{th}$ position) may be disposed such that its South-North direction is collinear to the South-North direction of the permanent magnets disposed just before and after it (or in other words, at the $(N-1)/2^{th}$ and at the $(N+3)/2^{th}$ positions, respectively), or opposite to their South-North direction. FIG. 6*a* shows an example of this embodiment, where the permanent magnet assembly is made of two permanent magnets (M1, M2). The field lines have been simulated with the software Vizimag 3.19.

Figure 6B:
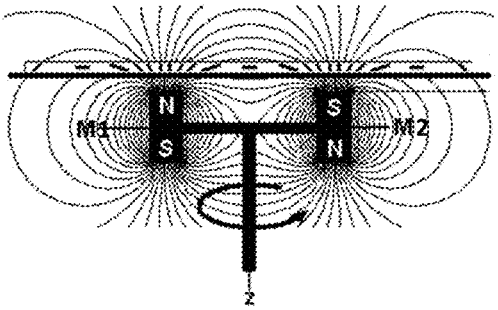

According to a fourth preferred embodiment, the permanent magnet assembly (PMA) comprises an even number of n bar dipole permanent magnets (n=1 . . . N, N≤2, N/2∈Z, Z being the mathematical space containing all integer numbers) aligned such as to correctly balance rotational inertia, their South-North directions being substantially perpendicular to the substrate/support surface and antiparallel to each other. In other words, the South-North direction of the first permanent magnet (n=1) is antiparallel to the South-North direction of the last permanent magnet (n=N), the South-North direction of the second permanent magnet (n=2) is antiparallel to the South-North direction of the penultimate permanent magnet (n=N−1), and so on, such that the South-North direction of the $n^{th}$ permanent magnet is antiparallel to the South-North direction of the $(N-n+1)^{th}$ permanent magnet. FIG. 6*b* shows an example of this embodiment, where the permanent magnet assembly is made of two permanent magnets (M1, M2). The field lines have been simulated with the software Vizimag 3.19.

The spinning permanent magnet assemblies (PMA) (6) of the first to fourth embodiments described hereabove give access, when integrated into the apparatus of the invention, to optical effects that are not accessible to non-spinneable permanent magnet assemblies (PMA) aimed at generating static magnetic fields.

Other embodiments of suitable spinning permanent magnet assemblies (PMA) (6) may be found in the co-pending European applications 13150693.3 and 13150694.1.

The one or more permanent magnets (M1, M2, M3, . . . Mn) comprised in the spinning permanent magnet assembly (PMA) (6) described herein are made of one or more strong magnetic materials. The one or more permanent magnets generate a sufficiently strong magnetic field to orient the magnetic or magnetizable pigment particles of the wet and not yet hardened coating composition described herein. Suitable strong magnetic materials are materials having a maximum value of energy product $(BH)_{max}$ of at least 20 kJ/m$^3$, preferably at least 50 kJ/m$^3$, more preferably at least 100 kJ/m$^3$, even more preferably at least 200 kJ/m$^3$.

The one or more permanent magnets (M1, M2, M3, . . . Mn) comprised in the permanent magnet assembly (PMA) are preferably made of one or more sintered or polymer bonded magnetic materials selected from the group consisting of Alnicos such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); hexaferrites of formula $MFe_{12}O_{19}$, (e.g. strontium hexaferrite ($SrO*6Fe_2O_3$) or barium hexaferrites ($BaO*_6Fe_2O_3$)), hard ferrites of the formula $MFe_2O_4$ (e.g. as cobalt ferrite ($CoFe_2O_4$) or magnetite ($Fe_3O_4$)), wherein M is a bivalent metal ion), ceramic 8 (SI-1-5); rare earth magnet materials selected from the group comprising $RECo_5$ (with RE=Sm or Pr), $RE_2TM_{17}$ (with RE=Sm, TM=Fe, Cu, Co, Zr, Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14.

Alternatively, the spinning permanent magnet assembly (PMA) (6) may further comprise, in addition to the one or more permanent magnets (M1, M2, M3, . . . Mn), one or more parts made of one or more magnetizable materials (Y1, Y2, Y3, . . . Yn) (also referred in the art as yokes or cores, pole pieces or magnetizable parts), and/or one or more parts made of one or more non-magnetic materials. Said one or more magnetizable parts serve to direct and concentrate the magnetic field generated by the one or more permanent magnets of the spinning permanent magnet assembly (PMA) (6). The one or more magnetizable parts are made of one or more soft magnetic materials, i.e. materials having high magnetic permeability (expressed as Newton per square Ampere, $N \cdot A^{-2}$) and low coercivity (expressed in Ampere per meter, $A \cdot n^{-1}$) to allow for fast magnetization and demagnetization. The permeability is preferably between about 2 and about 1,000,000, more preferably between about 5 and about 50,000 $N \cdot A^{-2}$ and still more preferably between about 10 and about 10,000 $N \cdot A^{-2}$. The coercivity is typically lower than 1000 $A \cdot m^{-1}$. The one or more soft magnetic materials described herein include without limitation pure iron (from annealed iron and carbonyl iron), nickel, cobalt, soft ferrites like manganese-zinc ferrite or nickel-zinc ferrite, nickel-iron alloys (like permalloy-type materials), cobalt-iron alloys, silicon iron and amorphous metal alloys like Metglas® (iron-boron alloy), preferably pure iron and silicon iron (electrical steel), as well as cobalt-iron and nickel-iron alloys (permalloy-type materials), which all exhibit a high permeability and a low coercivity. In addition to the one or more permanent magnets (M1, M2, M3, . . . Mn) described herein, alone or combined with one or more parts made of one or more of magnetizable materials (Y1, Y2, Y3, . . . Yn), and/or one or more parts made of one or more non-magnetic materials, the spinning permanent magnet assembly (PMA) (6) described herein may comprise an engraved magnetic plate such as those disclosed for example in WO 2005/002866 A1 and WO 2008/046702 A1, so as to locally modify the magnetic field of the one or more permanent magnets. Engraving influences the magnetic field generated by the one or more permanent magnets (M1, M2, M3, . . . Mn) to produce the desired OEL. In an embodiment, the engraving represents at least part of the desired OEL and is reproduced in the magnetic or magnetizable pigment particles under the influence of the rotating magnetic field generated by the spinning permanent magnet assembly (PMA) (6).

The embodiments of the at least one or more permanent magnets (M1, M2, M3, . . . Mn), the optional one or more parts made of magnetizable material (Y1, Y2, Y3 . . . Yn), the optional one or more parts made of non-magnetic material are in no way limited to the particular embodiments described above. Depending on the desired OEL, other embodiments are possible, the only limitation being the physical space available for the spinning permanent magnet assembly (PMA) (6) within the apparatus of the invention describes herein.

The spinning permanent magnet assembly (PMA) (6) described herein may be built from a casing bearing one or more recesses or holes in which the one or more permanent magnets (M1, M2, M3, . . . Mn), the one or more parts made of one or more magnetizable materials (Y1, Y2, Y3, . . . Yn) when present, and the one or more parts made of one or more non-magnetic materials when present, are inserted in a disposition suitable to generate the desired OEL. The optional casing is made of one or more materials selected from the group consisting of non-magnetic materials, soft magnetic materials, permanent magnetic materials and mixtures thereof. Preferably, the optional casing is made of non-magnetic, low or non-conducting materials. They may be the same as used to build the holder (1*a*, 1*b*), the support (3*a*, 3*b*) and the magnet holder (5*a*, 5*b*), or a different material selected from the same group. Preferably, the optional casing has the external shape of a disc or of a regular polygon, in order to correctly balance the mechanical forces while spinning. Alternatively, the optional casing may take the shape of an irregular polygon or of any irregular body and the mechanical balance may be established by balancing weights.

As shown in FIGS. 1 and 2, the apparatus of the invention described herein comprises a magnet holder (5*a*, 5*b*). The spinning permanent magnet assembly (PMA) (6) is fixed into the recess of the magnet holder (5*a*, 5*b*) through simple friction force, by gluing or by using one or more side screws made of a non-magnetic low conducting material or a non-conducting material, or by any other means known to somebody skilled in the art.

In one embodiment depicted in FIG. 1, the magnet holder (5*a*) bears the shaft required to removeably couple the permanent magnet assembly (PMA) (6) to the motor (2*a*).

Figure 16:
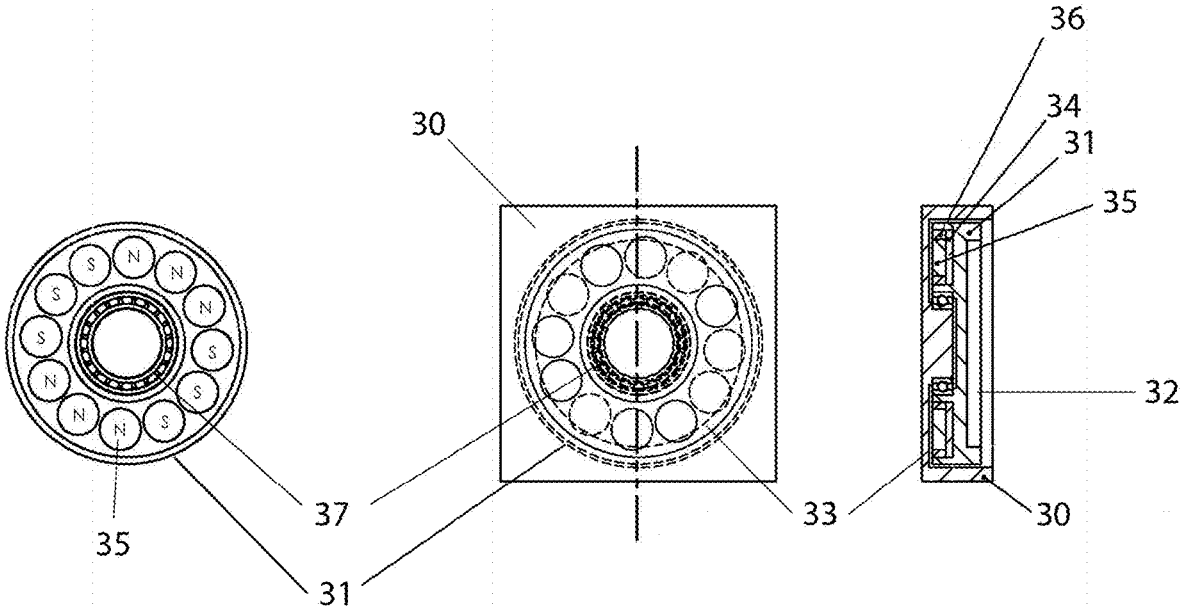
FIG. 16 schematically illustrates the embodiment of Example 2. The support (30) is machined with a cylindrical cavity and a hub that holds a bearing (37) onto which the magnet holder (31), the magnetizable disc-shaped element (34) and the permanent magnets (35) building together the rotor part of an electric motor are spinneably fixed. The spinning permanent magnet assembly (PMA) (6), which is fixed in the recess (32) of the magnet holder (31), has been omitted for clarity.

In another embodiment depicted in FIG. 2, the spinning permanent magnet assembly (PMA) (6) is removeably coupled to the holder (1*b*) through magnetic interaction between the rotor part (2*c*) placed in the support (3*b*) and the stator part (2*b*) placed in the holder (1*b*). In this case, the magnet holder (5*b*) may be machined to provide an upper recess onto which the spinning permanent magnet assembly (PMA) (6) is fixed and a bottom cavity that accommodates the magnetizable ring-shaped element (7), the bearing (4) and the rotor part (2*c*) of the electric motor. Such an arrangement is depicted in FIG. 16.

Preferably, the magnet holder (5*a*, 5*b*) has the external shape of a disc or of a regular polygon, in order to correctly balance the mechanical forces while spinning.

Suitable materials for the magnet holder (5*a*, 5*b*) may be the same as used for the optional casing of the spinning permanent magnet assembly (PMA) (6), the holder (1*a*, 1*b*) and the optional support (3*a*, 3*b*), or a different material selected from the same group.

According to FIGS. 1 and 2, the magnet holder (5*a*, 5*b*) is fixed to the support (3*a*, 3*b*) through a mechanical bearing (4). Typical examples of mechanical bearings include without limitation journal (or sleeve) bearings, roller bearings (particularly needle bearings) and ball bearings. Particularly preferred are ball bearings.

Suitable ball bearings are selected from the group consisting of fill-slot bearings, in which the geometry of the cage constrains the balls in the radial direction but leave them freely move in the axial direction, and Conrad-type bearings, in which the balls are constrained in the axial and the radial directions, thus allowing them to withstand both radial and axial loads. Conrad-type bearing are preferred since the apparatus described herein is suitable to be installed in the circumferential mounting grooves of a rotating magnetic cylinder (RMC), the rotation of said rotating magnetic cylinder (RMC) generating strong gyroscopic forces inside the apparatus of the invention described herein.

Preferably, the ball bearings described herein are selected from the group consisting of metal bearings, hybrid metal-ceramic bearings and plastic bearings. In a metal construction, the cage, the races and the balls of the bearing are made from a metal or a metal alloy. Metallic materials or metal alloys include without limitation austenitic steels like stainless steel, aluminum, titanium, tungsten, brass and copper. In a hybrid metal-ceramic bearing, the cage and the races of the bearing are made from metal, usually stainless steel or titanium, and the balls are made from a ceramic material. Commonly used ceramic materials include without limitation aluminum oxide (corundum), silicon nitride, silicon carbide, tungsten carbide, and silicon oxide (glass), from which silicon nitride is particularly preferred. In a plastic bearing, the cage and the races are made from the same plastic material, and the balls are made from the same or from a different material. Suitable plastics for making the cage and the races of the bearing include without limitation polyamides (like Nylon®), phenolic resins (like phenol-formaldehyde or Bakelite®), polyacetals (also known as POM, i.e. polyoxymethylenes), polypropylene, polyethylene, perfluorinated polyethylene (like PTFE or Teflon®), and suitable materials for making the balls may be the same as used for the cage and the ring, or may include other materials, like glass.

With the aim of reducing friction inside the bearing, lubricating agents may be used. Such lubricating agents include without limitation mineral oils, vegetable oils, synthetic oils, greases, silicone greases and fluoropolymer greases.

According to one embodiment depicted in FIG. 1, the apparatus comprises a holder (1*a*) and a disc-shaped BLDC motor (2*a*). In this embodiment, the spinneable coupling between the spinning permanent magnet assembly (PMA) (6) and the disc-shaped BLDC motor (2*a*) is mechanically achieved by using a shaft being part of a magnet holder (5*a*) and a corresponding recess in the rotor part of the disc-shaped BLDC motor (2*a*).

In a preferred embodiment, the disc-shaped BLDC motor (2*a*) has a stator part facing down the holder (1*a*) and a rotor part facing away from it and surrounding the stator part, as depicted on FIG. 1, said rotor part being equipped with a recess that removeably fits to the shaft that is connected to the magnet holder (5*a*).

In another embodiment, the disc-shaped BLDC motor (2*a*) has a rotor part facing down the holder (1*a*) and a stator part facing away from it, the lower rotor part being equipped with a shaft that goes through the upper stator part and is removeably connected to the shaft's coupling end of the magnet holder as previously described. The disc-shaped BLDC motor (2*a*) may possess one central rotor part and two stator parts, one facing down the holder (1*a*) and the other facing away from it. In such a case, the rotor part is equipped with a shaft that goes through the upper stator part and is removeably connected to the shaft's coupling end of the magnet holder (5*a*) as previously described.

In another embodiment, the disc-shaped BLDC (2*a*) motor is a motor of the type used in CD or DVD drives, which are designed to supply high torque in small mechanical dimensions. The construction of this motor is analogous to the motor depicted in FIG. 3. The rotor part, which faces away from the holder (1*a*), supports a mechanism providing for removeable coupling of the magnet holder (5*a*). This mechanism may be of a "balls and spring" type (as in KR 1997076654 A), or of a "claws and spring" type (as in JP 2008181622 A or JP 3734347 B2), or of a simple friction type (as described in JP 2003168256 A), or of any type known in the art.

In a particular embodiment of the bearing of the disc-shaped BLDC motor (2*a*), the bearing is of a hybrid, thin-section, large-diameter Conrad type and is fitted at the outer periphery of the rotor. This type of bearings usually comprises a cage and races made of stainless steel or titanium, and balls made of silicon nitride or another ceramic material. This embodiment may be particularly advantageous when the holder (1*a*) comprises a central fixation system (standard screw, Allen screw or bolt) which must remain accessible to removeably fix the holder (1*a*) in the circumferential mounting groove of a rotating magnetic cylinder (RMC) or in the mounting recess of a flatbed printing unit. In such a case, the stator part of the disc-shaped BLDC motor (2*a*) comprises a central hole to give access to the fixation system. The diameter of the hole is between 5 mm and 20 mm, preferably between 7 mm and 15 mm, even more preferably between 8 mm and 12 mm.

The current control unit (CCU) has a configuration that depends on the motor's construction. It is positioned on the same circuit board as the motor (2*a*) or on a separate board.

In the embodiment depicted in FIG. 1, the spinning permanent magnet assembly (PMA) (6) is positioned into the magnet holder (5*a*), said magnet holder (5*a*) comprising a shaft that removeably couples to a corresponding recess in the rotor part of the motor (2*a*). Any configuration of the shaft and of the corresponding recess known in art may be used. Suitable embodiments of the shaft and of the corresponding recess on the rotor may be found in "Mechanisms and Mechanical Devices Sourcebook" (Neil Sclater, McGraw-Hill, $5^{th}$ Edition, p. 311-317). Preferred are a shaft comprising square, triangular or polygonal splines with a recess of corresponding shape in the rotor, a shaft comprising straight-sided splines (usually 6, 8 or 10) and corresponding grooves in the recess of the rotor, a cylindrical shaft bearing longitudinal grooves (usually two, three or four) and corresponding splines in the recess of the rotor, a cylindrical shaft with low-pitch serrations and a corresponding cylindrical hole comprising a lining of elastomeric material in the rotor, a shaft comprising involute-form splines and corresponding grooves in the recess of the rotor, and a shaft comprising peripheral coupling teeth and corresponding notches in the recess of the rotor. In the case where the shaft bears low-pitch serrations and the recess of the rotor is lined with an elastomeric material, the shaft is advantageously tapered to simplify the coupling. With the aim of simplifying the coupling, other embodiments may also comprise tapered or chamfered parts, like splines, grooves or teeth and the like.

In such a case, the recess of the rotor preferably has a square, triangular, polygonal or regular polygonal shape and the shaft has a corresponding shape. The section of the recess of the rotor is chosen such as to allow easy access to the fixation system of the holder (1*a*) through the central hole of the stator.

In an embodiment, the bearing (4) spinneably holding the magnet holder (5*a*) and the spinning permanent magnet assembly (PMA) (6) may be placed at the outer periphery of the magnet holder (5*a*), thus allowing a more compact design but also slightly reducing the diameter of the spinning permanent magnet assembly (PMA) (6) and the area of the OEL.

According to one embodiment depicted in FIG. 2, the apparatus comprises a holder (1*b*) and the stator part (2*b*) of an electric motor. The rotor part (2*c*) of the motor is comprised within the magnet holder (5*b*) spinneably fixed via the bearing (4) in the cavity of the support (3*b*). The spinneable coupling between the spinning permanent magnet assembly (PMA) (6) and the holder (1*b*) is achieved through magnetic interaction between the rotor part (2*c*) and the pole piece of the stator part (2*b*) disposed in the holder (1*b*).

The rotor (2*c*) comprises one or more parts made of a strong magnetic material such as those described hereabove for the one or more parts (M1, M2, M3 . . . Mn) of the permanent magnet assembly (PMA). Preferably the rotor (2*c*) comprises one or more NdFeB or CoSm magnets. The rotor (2*c*) magnetically interacts with the magnet-wire coils of the stator (2*b*) to set the permanent magnet assembly (PMA) (6) into spinning.

As used herein, the term "winding assembly" refers to a plurality of magnet-wire coils that are connected to provide the stator part of an electric motor. Preferably, the winding assembly comprises two or more magnet-wire coils.

The construction of the rotor (2*c*) depends on the configuration of the winding assembly of the stator (2*b*) and on the way it is addressed with electric current by the current control unit (CCU). To obtain a net torque from an electric motor, the interaction product of the magnetic fields generated by the winding assembly of the stator (2*b*) and the permanent magnets of the rotor (2*c*), integrated between zero and 27, must be different from zero.

Figure 15:
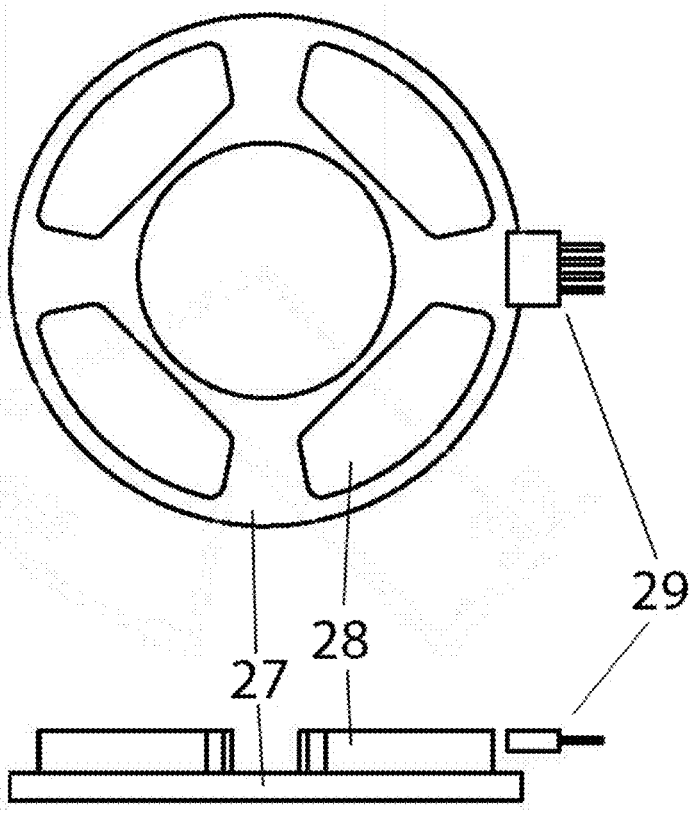
FIG. 15 schematically illustrates the stator (2*b*) used in Example 2, bearing four cores (28) aimed at receiving four magnet-wire coils. A motor controller (29) bearing an Hall-effect sensor is fixed between the cores on the right.

The stator part (2*b*) is made of a pole piece comprising at least two or more iron cores, a winding assembly and an optional current control unit (CCU). Such an arrangement is depicted in FIG. 15, where the pole piece (27) bears four cores (28) and a current control unit comprising a Hall-effect sensor (29). The pole piece and the two or more cores of the stator part (2*b*) serve to direct and intensify the magnetic flux B generated by the magnetic field H of the magnet-wire coils of the stator, according to the formula $B=\mu*H$, where p is the magnetic permeability (expressed in Newton per square Ampere, $N\cdot A^{-2}$) of the material making up the pole piece and the two or more cores. The pole piece and the two or more cores of the stator (2*b*) are independently made from one or more materials selected from the same group as described hereabove for the one or more magnetizable parts (Y1, Y2, Y3 . . . Yn) of the spinning permanent magnet assembly (PMA) (6). The pole piece and the at least two or more cores of the stator (2*b*) may be made in the form of a monolithic piece of magnetizable material. Preferably and with the aim of reducing eddy current losses, the pole piece and the two or more cores described herein are made from interrupted pieces of one or more magnetizable metals, metal alloys or combinations thereof, such as laminated sheets of electrical steel (transformer steel; iron-silicon alloy with 1 to 4% silicon content). The laminated sheets may be further electrically insulated from each other. In another embodiment, the pole piece and the two or more cores of the stator (2*b*) may be made from a plastic composite or a rubber composite containing a magnetizable metal powder, such as for example carbonyl-iron powder, in an electrically insulating solid plastic matrix or rubber matrix. Typical examples include without limitation carbonyl-iron filled epoxy resins and permalloy-powder filled acrylic resins. The advantage of such composite materials is the ease of mass-production—by simple molding or casting—of the pole piece and the two or more cores of the stator (2*b*); their disadvantage is the somewhat lower reachable magnetic permeability.

The winding assembly of the stator (2*b*) comprises two or more magnet-wire coils that are wound around the two or more cores of the pole piece of the stator (2*b*) using standard magnet wire having a copper or aluminum core and one or more insulating layers. Preferably, the magnet wire is of the "self-bonding" type, which means that the insulating layers are covered with a thermoplastic adhesive layer which can be activated by heat (hot air or oven) or by appropriate solvents. This allows the production of self-standing magnet-wire coils through a simple baking or solvent exposure after their winding onto an appropriate form.

Figure 4A:
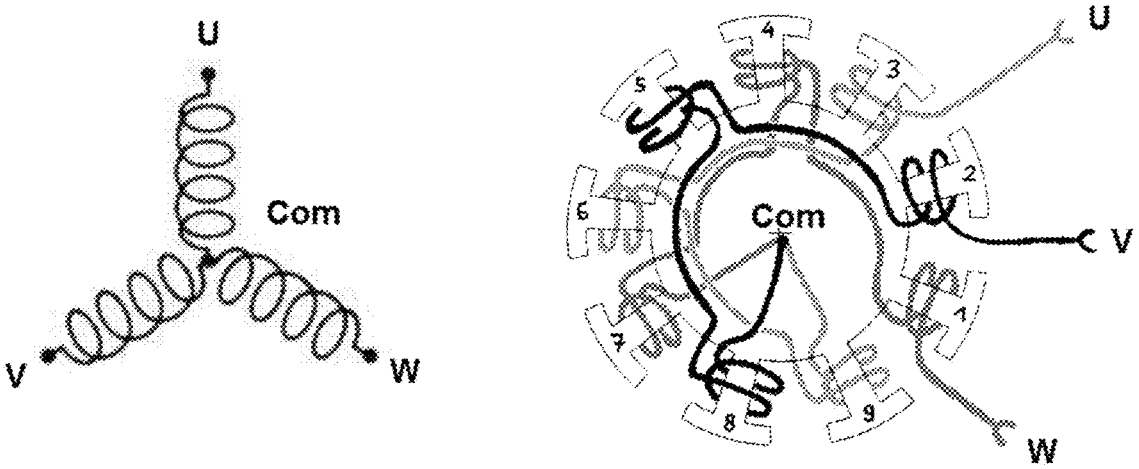
FIG. 4*a* schematically illustrates the phases of a 3-phase BLDC motor connected in a star (or "Y") configuration.
Figure 4B:
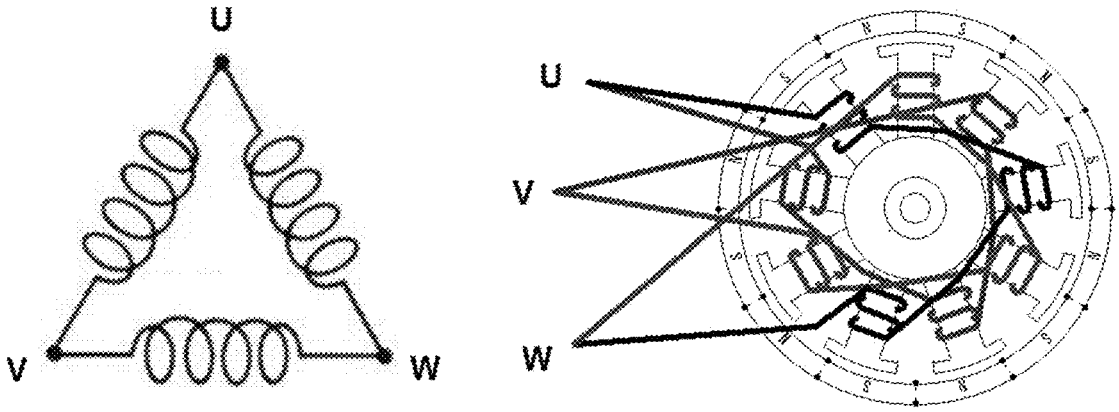
FIG. 4*b* schematically illustrates the phases of a 3-phase BLDC motor connected in a delta configuration.

The wires of the winding assembly of the stator (2*b*) are connected to an external current control unit (CCU). Preferably, the wires of the winding assembly of the stator are interconnected to form a 3-phase motor (U, V, W+Common) circuit of the "star" (or "Y") or "delta" type, as depicted in FIG. 4.

The current control unit (CCU) is preferably disposed close to the stator part (2*b*) of the electric motor, e.g. on the same circuit board, or on a separate board.

The gap distance between the rotor (2*c*) and the magnet-wire coils of the stator (2*b*) should be as small as possible to maximize the magnetic flux between the stator (2*b*) and the rotor (2*c*). Typically, said gap distance has a value between 0.1 mm and 3 mm, preferably between 0.3 mm and 1 mm.

Since the spinning permanent magnet assembly (PMA) (6) and the rotor (2*c*) are very close to each other, a ring-shaped element (7 in FIG. 2) made of one or more magnetizable materials may be inserted between the spinning permanent magnet assembly (PMA) (6) and the rotor (2*c*) to concentrate the field lines in the vicinity of the rotor (2*c*) and to minimize magnetic interferences between the rotor (2*c*) and the spinning permanent magnet assembly PMA (6). The one or more magnetizable materials described herein for the ring-shaped element (7) are selected from the group consisting of pure iron (from annealed iron and carbonyl iron), nickel, cobalt, soft ferrites like manganese-zinc ferrite or nickel-zinc ferrite, nickel-iron alloys (like permalloy-type materials), cobalt-iron alloys, silicon iron (electrical steel) and amorphous metal alloys like Metglas® (iron-boron alloy). Preferred are pure iron and silicon iron. The thickness of the ring-shaped element (7) depends on the selected material and the strength of the magnets and should be sufficient to minimize magnetic interferences between the rotor (2*c*) and the spinning permanent magnet assembly (PMA) (6), but not too high since the space available within the apparatus is limited. Said thickness is preferably between 0.1 mm and 5 mm, more preferably between 0.3 mm and 3 mm, and still more preferably between 0.5 mm and 1 mm.

According to the embodiment of FIG. 2, preferred materials for the bearing (4) are those which are non-magnetic and low or non-conducting, in order to avoid or minimize the formation of eddy currents caused by the proximity of the bearing (4) to the permanent magnet assembly (PMA) (6) and to the rotor (2*c*). Hybrid metal-ceramic bearings and plastic bearings are therefore preferred. Hybrid metal-ceramic bearings are more preferred, since they strike a balance between long-term wearing resistance and low conductivity. Hybrid metal-ceramic bearings with a cage and races made of stainless steel or titanium, and balls made of silicon nitride or silicon carbide, are particularly preferred.

In a preferred embodiment, the bearing (4) may be advantageously placed at the outer periphery of the magnetizable ring-shaped element (7), thus allowing for a more compact design without reducing the diameter of the spinning permanent magnet assembly (PMA). In this embodiment, a particularly preferred bearing is a hybrid Conrad-type ball bearing comprising a cage and races made of a non-magnetic, low-conducting metal like stainless steel or titanium, and ceramic balls like silicon nitride or silicon carbide.

The magnet holder (5*b*) carrying the spinning permanent magnet assembly (PMA) (6), the magnetizable ring-shaped element (7), the rotor (2*c*) and the bearing (4) is spinneably fixed to a hub of the cylindrical cavity of the support (3*b*). The hub may raise from the close bottom part of the support (3*b*) or coming down from the close upper part of the support (3*b*), which allows minimizing the gap between the rotor (2*c*) and the stator (2*b*). Alternatively, the hub may be fixed to both a close bottom part and a close upper part of the support (3*b*) to increase the robustness of the apparatus described herein.

Figure 7:
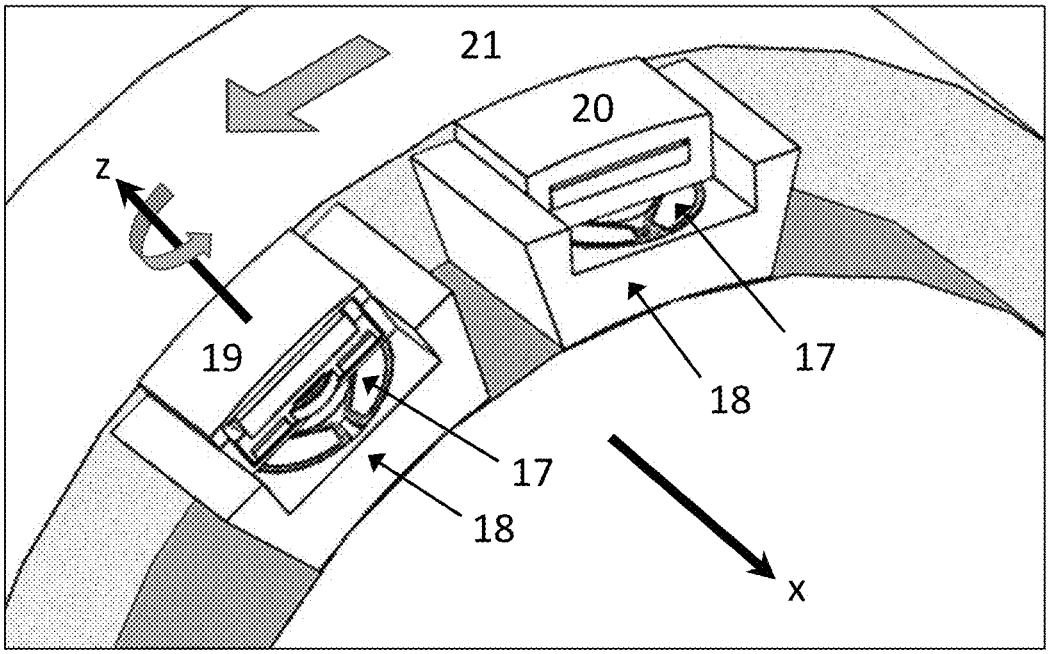
FIG. 7 schematically illustrates a rotating magnetic cylinder (RMC) (21) bearing an apparatus (19) according to the invention described herein, comprising a spinning permanent magnet assembly (PMA) (not shown) aimed at generating a rotating magnetic field and an apparatus (20) comprising a non-spinneable permanent magnet assembly (PMA) aimed at generating a static magnetic field. Both apparatuses further comprise a holder (18). The spinning permanent magnet assembly (PMA) (6) of the apparatus (19) spins around the z-axis while the rotating magnetic cylinder (RMC) rotates around the x-axis.

As shown in FIG. 7, the stator (17) is inserted into the holder (18) in such a way that it renders possible to removeably attach to the holder (18) a support comprising a spinning permanent magnet assembly (19) aimed at generating rotating magnetic fields, or a non-spinneable permanent magnet assembly (20) aimed at generating static magnetic fields. FIG. 7 further indicates how one or more permanent magnet assemblies (19) aimed at generating rotating magnetic fields and one or more non-spinneable permanent magnet assemblies (20) aimed at generating static magnetic fields may be installed on the same rotating magnetic cylinder (21) of the printing equipment. Here, the rotating magnetic cylinder (21) is shown rotating around the x-axis while the spinning permanent magnet assembly (19) spins around the z-axis.

As shown in FIGS. 1 and 2, as well as in FIG. 7, the apparatus described herein may be closed by a non-spinning lid (8) whose external shape seamlessly conforms to the external surface of the rotating magnetic cylinder or of the flatbed printing unit wherein said apparatus may be incorporated. The apparatus described herein may be inserted into a circumferential mounting groove of the rotating magnetic cylinder (RMC) or in a mounting recess of a flatbed printing unit in such a way that it generates a seamless support surface for the substrate carrying the wet and not yet hardened coating composition containing magnetic or magnetizable pigment particles. The material used to make the lid (8) is selected from the group consisting of engineering plastics and polymers, titanium, titanium alloys and non-magnetic steels. The lid may advantageously comprise in addition one or more static magnets, in particular an engraved magnetic plate, as disclosed for example in WO 2005/002866 A1 and WO 2008/046702 A1. Such an engraved plate may be made from iron or, alternatively, from a plastic material in which magnetic particles are dispersed (such as for example Plastoferrite). In this way, the OEL produced by the spinning permanent magnet assembly (PMA) (6) can be overlaid with a magnetically induced fine-line pattern, such as a text, an image or a logo. The lid (8) may be fixed to the support (3*a*, 3*b*) in any way known in the art, such as screwing (standard screw, Allen screw or bolt), riveting or gluing. In a preferred embodiment, the lid (8) is glued to the support (3*a*, 3*b*), in order to increase the reliability of the apparatus described herein.

The spinning frequency of the spinning permanent magnet assembly (PMA) (6) is preferably chosen such that it undergoes at least one complete revolution over the course of exposure of the magnetic or magnetizable pigment particles to the rotating magnetic field. The spinning permanent magnet assembly (PMA) (6) will spin at least once through a full revolution to ensure that a rotationally symmetric aggregate orientation of the magnetic or magnetizable pigment particles is produced to result in the desired OEL.

When the apparatus of the invention described herein is part of a rotating magnetic cylinder (RMC) for orienting magnetic or magnetizable pigment particles of the printed coating composition, the required spinning frequency depends on the printing speed of the printing or coating equipment comprising said rotating magnetic cylinder (RMC), on the position of the hardening device and on the construction of the spinning permanent magnet assembly (PMA) (6). The speed of rotation of the outer periphery of the rotating magnetic cylinder (RMC), and thus the speed of movement of the substrate in the machine direction, and the spinning frequency of the spinning permanent magnet assembly (PMA) (6) are set such that the spinning permanent magnet assembly (PMA) (6) performs at least one complete revolution) (360° while the part of the substrate carrying the coating composition is on the rotating magnetic cylinder (RMC) and hence exposed to the generated rotating magnetic field. The part of the coating composition exposed to the rotating magnetic field remains stationary relative to the rotating magnetic cylinder (RMC) to ensure the quality of the OEL. In an embodiment, the spinning permanent magnet assembly (PMA) (6) performs at least one complete revolution)(360° during the application of the rotating magnetic field to the magnetic or magnetizable pigment particles as the spinning permanent magnet assembly (PMA) (6) and the substrate moves in the machine direction at the same speed. For typical industrial printing speeds of at least 8000 sheets per hour, typically 8,000 to 10,000 sheets per hour, the required spinning frequency is preferably at least around 50 Hz, more preferably at least around 30 Hz, and even more preferably at least around 50 Hz.

When the apparatus of the invention described herein is part of a flatbed printing unit, the required spinning frequency of the spinning permanent magnet assembly (PMA) (6) depends on the printing speed (in sheets per hour) of said flatbed printing unit, on the position of the hardening device and on the construction of the permanent magnet assembly (PMA) (6). The spinning frequency of the spinning permanent magnet assembly (PMA) (6) is set such that the spinning permanent magnet assembly (PMA) (6) makes at least one complete revolution while the part of the substrate carrying the coating composition is on of the flatbed printing unit comprising the one or more apparatuses of the invention, and hence exposed to the generated rotating magnetic field. For typical industrial printing speeds of 100-300 sheets per hour, the spinning frequency required is preferably at least around 0.5 Hz, more preferably at least around 5 Hz, and even more preferably at least around 20.

The apparatus described herein has a surface to be brought in contact with, or close to, a substrate surface carrying a wet and not yet hardened coating composition comprising magnetic or magnetizable pigment particles. The substrate feeder feeds the substrate (under the form of a web or sheets) such as to expose the magnetic or magnetizable pigment particles dispersed in the wet and not yet hardened coating composition to the rotating magnetic field produced by the spinning permanent magnet assembly (PMA) (6). To this aim, the magnetic or magnetizable pigment particles must be brought into sufficiently close proximity to the rotating magnetic field such that the local field strength of the magnetic field is high enough to aggregately orient the magnetic or magnetizable pigment particles so as to produce the desired OEL. Preferably, the distance between the spinning permanent magnet assembly (PMA) (6) and the coating composition comprising the magnetic or magnetizable pigment particles is between 0.1 and 10 mm, preferably between 0.2 and 5 mm, more preferably between 0.5 and 3 mm.

The device is preferably built in such a way that the spinning axis z of the spinning permanent magnet assembly (PMA) (6) is substantially perpendicular to the substrate surface. A rotating magnetic field of a desired pattern is generated by the spinning permanent magnet assembly (PMA) (6). The rotating magnetic field acts on the magnetic or magnetizable pigment particles dispersed in the wet and not yet hardened coating composition to aggregately orient the particles so as to produce the desired OEL. Upon the exposure of the magnetic or magnetizable pigment particles to the rotating magnetic field, rotationally symmetric optical effects depending on the configuration of the spinning permanent magnet assembly (PMA) (6) are obtained. Examples of effects are disclosed in the co-pending European patent applications 13150694.1 and 13150693.3.

The rotating magnetic cylinder (RMC) comprising one or more apparatuses of the invention described herein is preferably part of a rotary, continuous printing press. The coating composition is applied by a printing process selected from the group consisting of screen printing, intaglio printing, rotogravure printing and flexography printing. Preferably, the coating composition is applied by a screen printing process.

WO 2008/102303 A1 FIG. 1 schematically depicts a screen printing press comprising a rotating magnetic cylinder (RMC) according to the second aspect of the invention described herein. The printing press includes a substrate feeder feeding the substrate under the form of sheets to a screen printing group where specific patterns of a coating composition are applied to the substrate by mean of one or more screen printing cylinders placed in succession along the printing path of the sheets. The freshly printed sheets carrying the wet and not yet hardened coating composition are conveyed to the rotating magnetic cylinder (RMC) comprising the one or more apparatuses of the first aspect of the invention (as described in FIGS. 1 and 2), where the magnetic or magnetizable pigment particles of the coating composition are aggregately oriented by the spinning permanent assemblies (PMA) (6). The sheets are then conveyed downstream to the hardening unit, where the oriented magnetic or magnetizable pigment particles are frozen in a substantially oriented state or oriented state. Preferably, the hardening unit is a UV-curing unit. Preferably, the hardening unit is disposed over the rotating magnetic cylinder (RMC), as described in WO 2012/038531 A1 or EP 2433798 A1, so that the coating composition is at least partially hardened while the substrate carrying the coating composition is in contact with the rotating magnetic cylinder (RMC). A subsequent hardening unit (radiation curing, preferably UV-curing, infrared and/or heat) may be disposed further downstream to provide for complete hardening of the coating composition. Further details regarding screen printing presses can be found in EP 0723864 A1, WO 97/29912 A1, WO 2004/096545 A1 and WO 2005/095109 A1.

Subsequently or partially simultaneously (as described in WO 2012/038531 A1) with the orientation of the magnetic or magnetizable pigment particles by the rotating magnetic field generated by the spinning permanent magnet assembly (PMA) (6) of the apparatus described herein, the coating composition comprising said pigment particles is hardened to thereby fix or freeze the magnetic or magnetizable pigment particles in the substantially oriented state or oriented state. By "partially simultaneously", it is meant that both steps are partly performed simultaneously, i.e. the times of performing each of the steps partially overlap. In the context described herein, when hardening is performed partially simultaneously with the orientation step b), it must be understood that hardening becomes effective after the orientation so that the pigment particles orient before the complete hardening of the OEL.

Therefore, to ensure that the coating composition is hardened partially simultaneously with the orientation of the magnetic or magnetizable pigment particles provided by the one or more apparatuses of the invention described herein, the hardening device may be arranged along the path of the substrate above the rotating magnetic cylinder (RMC).

The flatbed printing unit comprising one or more apparatuses of the invention described herein is preferably part of a longitudinal, discontinuous printing press. The coating composition is applied by a printing process preferably selected from the group consisting of screen printing and intaglio printing. Preferably, the coating composition is applied by a screen printing process.

The press comprises a flat printing screen and a printing platen for receiving the substrate under the form of sheets, and a magnetic orienting unit comprising one or more apparatuses described herein (as described in FIGS. 1 and 2). The printing press additionally comprises a hardening unit, preferably a UV-curing unit. The magnetic orienting unit is disposed below the upper surface of the printing platen. The one or more apparatuses of the invention described herein are concomitantly moveable from a first position away from the upper surface of the printing platen ("remote position") to a second position close to it ("close position"). Printing, orienting and hardening of the coating composition comprising the magnetic or magnetizable pigment particles take place in the following sequence:

A sheet is manually or automatically loaded onto the upper surface of the printing platen with the apparatus in remote position.

The printing screen is placed over the sheet, and the coating composition is applied onto selected parts of the sheet to form printed patterns.

The printing screen is removed, and the one or more apparatuses of the invention described herein are moved in close position to the upper surface of the printing platen, at the location of the printed patterns.

The spinning permanent magnet assemblies (PMA) (6) aggregately orient the magnetic or magnetizable pigment particles of the wet and not yet hardened coating composition.

While spinning, the one or more apparatuses described herein are moved away in remote position from the printing platen.

The wet and not yet hardened coating composition is exposed to the hardening unit, where the pigment particles are frozen in a substantially oriented state or oriented state.

Further details regarding the process of printing and orienting magnetizable or magnetic pigment particles using a flatbed printing unit may be found in WO 2010/066838 A1.

Preferably, the coating composition is an ink or coating composition selected from the group consisting of radiation curable compositions, thermally drying compositions, oxidatively drying compositions, and combinations thereof. Particularly preferably, the coating composition is an ink or coating composition selected from the group consisting of radiation curable compositions. Radiation curing, in particular UV-Vis curing, advantageously leads to a rapid increase in viscosity of the coating composition after exposure to the curing radiation, thus preventing any further movement of the pigment particles and in consequence any loss of orientation after the magnetic orientation step.

According to one embodiment of the invention describes herein, a plurality of the apparatuses described herein, each one comprising a holder (1*a*, 1*b*), a motor (2*a*, 2*b*+2*c*), a permanent magnet assembly (PMA) (6) and, according to embodiments of the first aspect of the invention, a support (3*a*, 3*b*), may be removeably fixed adjacent to one another longitudinally and/or laterally in the mounting recesses of a flatbed screen printing machine, as described in WO 2010/066838 A1, or in circumferential mounting grooves of a rotating magnetic cylinder (RMC), as described in WO 2008/102303 A2. Each one of the plurality of apparatuses described herein is able to aggregately orient the magnetic or magnetizable pigment particles of the wet and not yet hardened coating composition according to the pattern defined by the spinning permanent magnet assembly (PMA) (6) and the optional engraved plate comprised in the lid, thereby creating a plurality of individual OEL's. The individual OEL's will be spaced, but adjacent to one another, along the width and the length of the substrate, according to the spacing and arrangement of the apparatuses described herein.

Optionally, a cover plate according to WO2008/102303A2, made of a non-magnetic material such as austenitic steel, aluminum, titanium or an engineering plastic or polymer, may be used to cover the apparatuses of the invention described herein. This ensures that the surface of the rotating magnetic cylinder (RMC) is substantially uniform and that the sheets or web fed from the substrate feeder seamlessly transfer to the surface of the rotating magnetic cylinder (RMC). Advantageously, the cover plate may be provided with openings at the locations corresponding to the position of the apparatuses of the invention described herein.

The substrate feeder is configured to feed the sheets or web and the rotating magnetic cylinder (RMC) is configured to rotate in such a way that, as long as the portion of the substrate carrying the wet and not yet hardened composition is in contact with the rotating magnetic cylinder (RMC), it is stationary relative to the spinning permanent magnet assembly (PMA) (6). By the subsequent, partially simultaneous or partially simultaneous hardening of the coating composition comprising the oriented magnetic or magnetizable pigment particles, an array of individual OEL's is produced on the sheet or web.

Should the operator of the printing equipment want to produce other optical effects generated by static magnetic fields, due to the holder (1*a*, 1*b*) being removeably coupled to the base of the rotating magnetic cylinder (RMC) or the flatbed printing unit, it is possible to easily replace one or more spinning permanent magnet assemblies (PMA) (6) as described herein with one or more non-spinneable permanent magnet assemblies (PMA) as known in the art. It may also be possible to install one or more apparatuses described herein and one or more apparatuses comprising non-spinneable permanent magnet assemblies (PMA) on the same rotating magnetic cylinder (RMC) or on the same flatbed printing unit.

The methods and apparatuses described herein are particularly suitable for making optical effect layers in the field of security, cosmetic and/or decorative applications. According to one embodiment, the substrate described herein is a security document such as those described hereabove.

Also described herein are uses of the apparatus described herein for making an optical effect layer on the substrate, said substrate being preferably a security document.

Also described herein are methods for protecting a security document, said method comprising the steps of i) applying, preferably by a printing process described herein, the coating composition comprising magnetic or magnetizable pigment particles described herein on the substrate described herein, ii) exposing the coating composition to the rotating magnetic field of apparatuses described herein so as to aggregately orient at least a part of the magnetic or magnetizable pigment particles to produce rotationally symmetric optical effects, and iii) hardening the coating composition so as to fix the magnetic or magnetizable pigment particles in their adopted orientations and positions.

An aspect of the present invention relates to security documents comprising the OEL obtained by the apparatus of the invention described herein. Each security document may comprise more than one OELs, i.e., during the printing and orienting process, more than one OEL may be produced on the same sheet or security document.

Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transaction cards, access documents or cards, entrance tickets, public transportation tickets or titles and the like, preferably banknotes, identity documents, right-conferring documents, driving licenses and credit cards. The term "value commercial good" refers to packaging materials, in particular for cosmetic articles, nutraceutical articles, pharmaceutical articles, alcohols, tobacco articles, beverages or foodstuffs, electrical/electronics articles, fabrics or jewellery, i.e. articles that shall be protected against counterfeiting and/or illegal reproduction in order to warrant the content of the packaging like for instance genuine drugs.

Examples of these packaging materials include without limitation labels, such as authentication brand labels, tamper evidence labels and seals.

Alternatively, the OEL may be produced on an auxiliary substrate such as for example a security thread, security stripe, a foil, a decal, a window or a label and consequently transferred to a security document in a separate step.

EXAMPLES

All examples have been carried out by using the UV-curable screen printing ink of the formula given in Table 1 below.

TABLE 1

| | |
|---|---|
| Epoxyacrylate oligomer | 28% |
| Trimethylolpropane triacrylate monomer | 19.5% |
| Tripropyleneglycol diacrylate monomer | 20% |
| Genorad 16 (Rahn) | 1% |
| Aerosil 200 ® (Evonik) | 1% |
| Speedcure TPO-L (Lambson) | 2% |
| Irgacure ® 500 (BASF) | 6% |
| Genocure EPD (Rahn) | 2% |
| BYK ®-371 (BYK) | 2% |
| Tego Foamex N (Evonik) | 2% |
| platelet-shaped 7-layer optically variable magnetic pigment particles (*) | 16.5% |

(*) gold-to-green optically variable magnetic pigment particles of diameter d50 about 9.5 μm and thickness about 1 μm, obtained from JDS-Uniphase, Santa Rosa, CA.

Example 1

Figure 8:
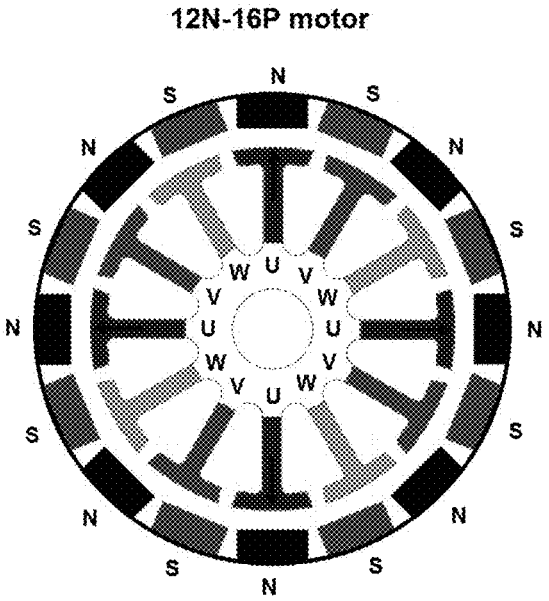
FIG. 8 schematically illustrates a construction of the BLDC motor used in Example 1. The depicted BLDC motor comprises 12 stator poles and 16 permanent magnets at the periphery of the rotor.
Figure 9:
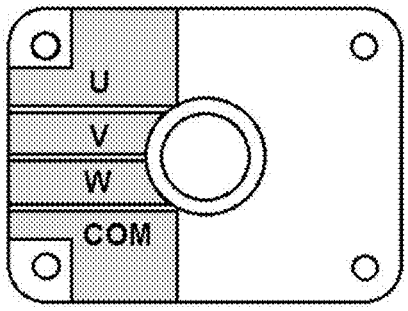
FIG. 9 schematically illustrates an epoxy plate on which the BLDC motor is fixed, as used in Example 1. COM stands for Common. The three phases are indicated as U, V and W.
Figure 11:
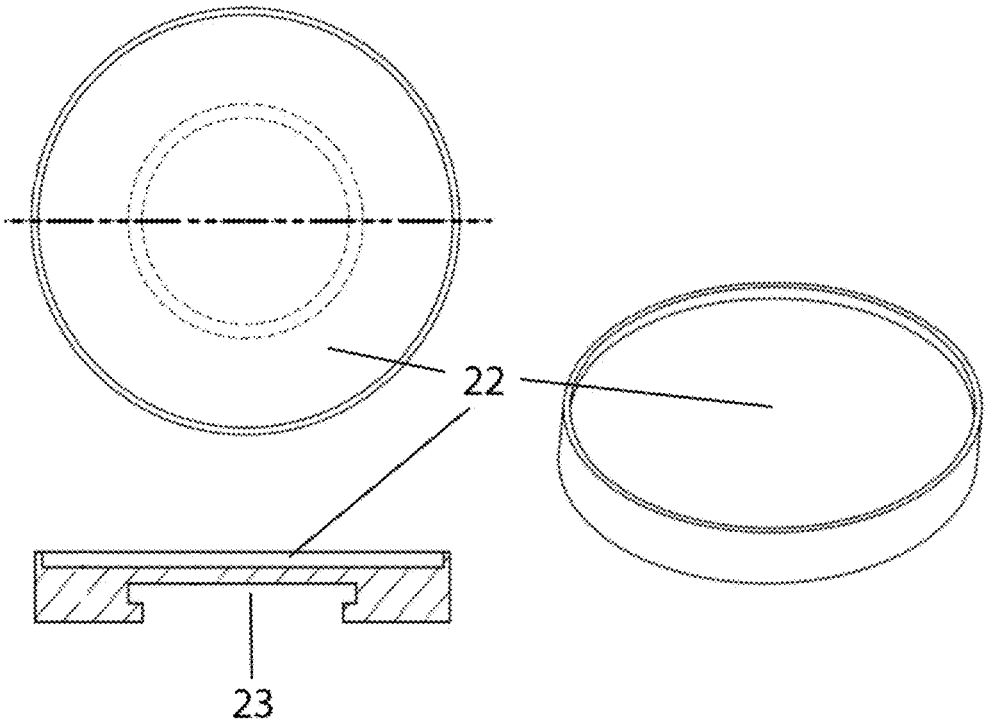
FIG. 11 shows the technical drawing of the magnet holder (5*a*) used in Example 1. The cavity (23) of the magnet holder is removeably fixed onto the coupling mechanism of the BLDC motor. The recess (22) is aimed at receiving a spinning permanent magnet assembly (PMA) (6).

An apparatus according to the invention described herein was used to orient the optically variable magnetic pigments of the ink detailed in Table 1. Said apparatus comprised:

i) a holder (depicted in FIG. 12) made of POM (corresponding to 1*a* in FIG. 1) and comprising a rectangular cavity of dimensions 38×30×8 mm (24) in its center to receive the disc-shaped BLDC motor i) and the epoxy base plate ii); the holder further comprised ii) a glass-fiber epoxy base plate (FR4 material) having the following dimensions: 38×30×2 mm and having four copper pads for U, V, W and Common (depicted in FIG. 9); and iii) a three phase disc-shaped BLDC motor (corresponding to 2*a* in FIG. 1) having an external diameter of 28 mm and a thickness of 6 mm, and being of type 24C (supplied by NIDEC Corp). This motor had an inner wire-wound 12-pole stator and an outer 16-pole permanent magnetic rotor (also known as "12N-16P" motor, depicted in FIG. 8). The winding pattern of the 12 magnet-wire coils of the stator was UVWUVWUVWUVW, i.e. all coils belonging to each phase U, V, and W excited in series in the same radial sense, and electrically connected according to a 3-phase star (or Y) configuration (depicted in FIG. 4*a*), resulting in four external connectors U, V, W and Common. The bell-shaped rotor of this motor, comprising 16 permanent magnets, was spinneably anchored in a ball bearing located in the central part of the stator. The rotor was equipped with a "claws and spring" coupling to accommodate the magnet holder v) described hereafter;

iv) a Texas Instruments DRV10866 circuit, 5V, 3-phase, sensorless motor driver (depicted in FIG. 10), wherein U, V and W being the three phases; COM, GND, VCC and PWM standing for Common, Ground, Voltage at Common Collector and Pulse Width Modulation; and M being the BLDC disc-shaped motor;

v) a magnet holder (depicted in FIG. 11 and corresponding to 5*a* in FIG. 1) with an outer diameter of 31 mm and a thickness of 4.5 mm, machined to provide on one side a cylindrical recess (22) of 1 mm depth to receive a permanent magnet assembly (PMA) aimed at orienting the optically variable magnetic pigment particles of the printed coating composition described in Table 1, and, on the other side, a cavity (23) to removeably couple the holder onto the "claws and springs" coupling of the motor iii);

vi) a nickel-coated NdFeB disk-shaped dipolar permanent magnet corresponding to (6) in FIG. 1 (Webcraft GmbH, diameter: 30 mm diameter, thickness: 3 mm) magnetized along its diameter.

The disc-shaped BLDC motor iii) was fixed onto the base plate ii) and both were inserted into the holder i). The permanent magnet vi) was glued with an epoxy glue (UHU 30 min) onto the magnet holder v), which was removeably fixed onto the motor iii) via its "claws and spring" coupling mechanism. The U, V, W and Common connector pads of the base plate were connected to the motor driver iv) according to FIG. 10. The pulse-width-modulation input ($PWM_{IN}$) served to electronically set the required spinning frequency. The motor driver iv) was externally powered with a laboratory power supply GW Instek GPS-4303 set at a voltage of 5V.

A 25 mm×25 mm square sample was printed onto a fiduciary paper (Louisenthal) with the UV-curable screen printing ink of Table 1 with a laboratory screen printing device. The thickness of the printed layer was about 20 μm. While the ink was still in a wet and not yet hardened state, the apparatus described hereabove was placed on the rear face of the substrate, 3 mm below the printed area, and allowed to spin for a few seconds at an estimated spinning frequency of about 30 Hz. The ink was hardened while being in the magnetic rotating field of the apparatus by a 0.5 s exposure to an UV LED (Phoseon FireFly 395 nm) positioned at a distance of about 50 mm from the substrate above the coating composition.

The photographic picture of the resulting OEL, representing a portion of a sphere, is shown in FIG. 13.

Example 2

An apparatus according to the invention described herein was used to orient the optically variable magnetic pigments of the ink detailed in Table 1. Said apparatus comprised:

i) a holder (depicted in FIG. 14) made of POM (corresponding to 1*b* in FIG. 2) and comprising a cylindrical cavity (26) in its center to receive the stator ii); the holder i) further comprised ii) a stator depicted in FIG. 15, comprising a pure iron (AK STEEL) pole piece (27) bearing four cores (28). The cores (28) were wound with four magnet-wire coils comprising each 200 turns of 0.15 mm copper enamel wire (POLYSOL 155 1×0, 15 MM HG from Distrelec AG). The magnet-wire coils were connected so as to drive the rotor vi) in a 2-phase sequence by using iii) an AH2984 (DIODES Inc.) motor controller (29), said motor controller being positioned between the magnet-wire coils of the stator;

iv) a support (30 in FIG. 16) made of POM, having the following dimensions: 40×40×10.2 mm, and comprising v) a magnet holder Ø35×7 mm (31 in FIG. 16), machined on one side with a recess (32) having a diameter of 30 mm and a depth of 1 mm to receive a permanent magnet assembly (PMA) ix) aimed at orienting the optically variable magnetic pigment particles of the coating composition described in Table 1 and, on the other side, with a ring-shaped cavity (33) carrying vi) a pure iron (AK STEEL) ring-shaped element (34) and vii) a rotor made of 12 NdFeB N45 disc permanent magnets Ø6×2 mm (35) (Webcraft GmbH), magnetized along their thickness and disposed in quadrupole layout. The permanent magnets (35) of the rotor vii) were spaced by 2 mm thick spacing elements made of POM (36) and glued with an epoxy glue (UHU 30 min) to the pure iron ring-shaped element (34) vi). The magnet holder (31) v) was spinneably fixed to the support (30) iv) via viii) a hybrid stainless steel/ceramic Conrad-type bearing (37) having an external diameter of 15 mm, an internal diameter of 10 mm and a thickness of 3 mm, and equipped with $Si_3N_4$ ceramic balls; the magnet holder (31) v) further comprised ix) a permanent magnet assembly (PMA) made of three NdFeB magnets of dimensions 5×5×5 mm, inserted in three recesses of a casing made of POM and having a diameter of 30 mm and a thickness of 5 mm. The permanent magnets were placed at a distance of 1 mm from each other and had their magnetization axis along the diameter of the casing, their South-North directions being collinear. The permanent magnet assembly (PMA) ix) was glued (UHU 30 min) into the recess of the magnet holder (31) v).

The stator ii) was glued into the cylindrical cavity of the holder i) with an epoxy glue (UHU 30 min). The support iv) comprising the permanent magnet assembly (PMA) ix) was inserted into the holder i) and maintained into place by the addition of friction force and magnetic interaction between the iron core of the stator ii) and the permanent magnets of the rotor vii). The stator ii) was externally powered with a laboratory power supply GW Instek GPS-4303 set at a voltage of 9V and driven via the motor controller iii).

A 25 mm×25 mm square sample was printed onto a fiduciary paper (Louisenthal) with the UV-curable screen printing ink of Table 1 with a laboratory screen printing device. The thickness of the printed layer was about 20 μm. While the ink was still in a wet and not yet hardened state, the apparatus hereabove was placed on the rear face of the substrate, 3 mm below the printed area, and allowed to spin for a few seconds at an estimated spinning frequency of about 15 Hz. The spinning axis of the permanent magnet assembly (PMA) was perpendicular to the substrate surface. The ink was hardened while being in the rotating magnetic field of the device by being exposed during 0.5 s to an UV LED (Phoseon FireFly 395 nm) positioned at a distance of about 50 mm from the substrate carrying the coating composition.

Figure 17:
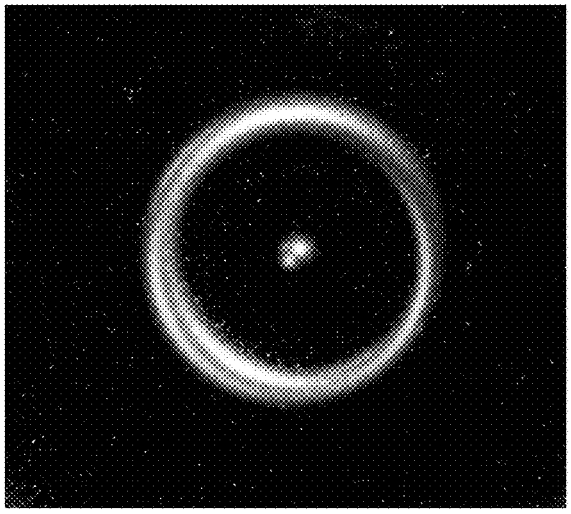
FIG. 17 shows a optical effect layer (OEL) obtained with the device of Example 2.

The photographic picture of the resulting OEL, representing a ring with a central bump, is shown in FIG. 17.

The invention claimed is:

1. An apparatus for producing an optical effect layer, comprising:

a holder, including surrounding sidewalls and an accommodating recess spatially defined by the surrounding sidewalls, along an axis the holder having mounted thereto in the accommodating recess:

a motor;

a permanent magnet assembly; and a support configured to be removably fixed to the holder, wherein the support accommodates the permanent magnet assembly, wherein the motor is configured to spin the permanent magnet assembly around the axis in the support, wherein the holder includes a bottom surface and a removable fixation on the bottom surface, the bottom surface is curved according to a curvature radius of a circumferential mounting groove of a rotating magnetic cylinder of a printing unit, and the removable fixation of the holder is configured to be removably fixed to the circumferential mounting groove of the rotating magnetic cylinder of the printing unit, wherein the axis is substantially perpendicular to the bottom surface of the holder;

wherein the holder includes a lower recess between the accommodating recess and the bottom surface, at least a part of the motor is disposed in the lower recess of the holder, and the motor includes a central hole to provide access to the removable fixation: and wherein the permanent magnet assembly is removably fixed to the holder.

2. The apparatus of claim 1, wherein the motor comprises a rotor part and a stator part, wherein the rotor part further comprises a recess, and the permanent magnet assembly is removably couplable to the recess via a rotation transmission shaft.

3. The apparatus of claim 1, wherein the motor comprises a rotor part and a stator part, and wherein the rotor part is disposed within the cavity of the support and the stator part is located external of the support and electromagnetically coupled to the rotor part.

4. The apparatus of claim 3, wherein a ring-shaped element that interacts with the magnetic field of the rotor part is disposed between the permanent magnet assembly and the rotor part.

5. The apparatus of claim 1, wherein the permanent magnet assembly is fixed to the support by a bearing to allow for relative rotation therebetween.

6. The apparatus of claim 5, wherein the bearing is a Conrad-type bearing.

7. A rotating magnetic cylinder comprising at least one of the apparatuses of claim 1 mounted to the rotating magnetic cylinder through the holder.

8. A method of making an optical effect layer on a substrate, the method comprising:

providing a substrate carrying a wet coating composition comprising magnetic or magnetizable pigment particles;

providing an apparatus according to claim 7;

orienting the magnetic or magnetizable pigment particles aggregately by way of a rotating magnetic field produced by spinning the permanent magnet assembly with the motor to produce the optical effect layer; and hardening the coating composition.

9. A method for protecting a security item, such as a banknote, comprising the steps of:

i. applying a coating composition comprising magnetic or magnetizable pigment particles to a substrate;

ii. exposing the coating composition to a rotating magnetic field produced by the spinning permanent magnet assembly of an apparatus of claim 7 to substantially orient at least part of the magnetic or magnetic pigment particles aggregately to produce an optical effect layer;

iii. hardening the coating composition so as to fix the magnetic or magnetizable pigment particles in a substantially oriented state or oriented state.

10. A method of making an optical effect layer on a substrate, the method comprising:

providing a substrate carrying a wet coating composition comprising magnetic or magnetizable pigment particles;

providing an apparatus according to claim 1;

orienting the magnetic or magnetizable pigment particles aggregately by way of a rotating magnetic field produced by spinning the permanent magnet assembly with the motor around the axis to produce the optical effect layer; and hardening the coating composition.

11. A method for protecting a security item, such as a banknote, comprising the steps of:

i) applying a coating composition comprising magnetic or magnetizable pigment particles to a substrate;

ii) exposing the coating composition to a rotating magnetic field produced by the spinning permanent magnet assembly of the apparatus of claim 1 to substantially orient at least part of the magnetic or magnetic pigment particles aggregately to produce an optical effect layer;

iii) hardening the coating composition so as to fix the magnetic or magnetizable pigment particles in a substantially oriented state or oriented state.

12. The apparatus of claim 1, wherein the holder is configured to be removably fixed to the circumferential mounting groove of the rotating magnetic cylinder, and wherein the holder and support are configured to move together concomitantly with the rotating magnetic cylinder.

13. The apparatus of claim 1, wherein the support is fixed so that the support is immovable relative to the holder.

14. The apparatus of claim 1, wherein the motor is mounted inside of the holder.

15. The apparatus of claim 1, further comprising a magnet holder comprising a recess in which the permanent magnet assembly is disposed, wherein the magnet holder is located between the permanent magnet assembly and the motor.

16. A method of modifying an existing rotating magnetic cylinder of a printing unit having non-spinable permanent magnet assemblies which are mounted to an accommodating recess of a holder along an axis, the method comprising;

removing one or more non-spinnable permanent magnet assemblies along the axis from the rotating magnetic cylinder of a printing unit; and replacing them with one or more spinnable permanent magnet assemblies spinning around the axis, wherein the one or more spinnable permanent magnet assemblies are removably fixed to the accommodating recess of the holder, wherein the holder includes a bottom surface and a removable fixation on the bottom surface, the bottom surface is curved according to a curvature radius of a circumferential mounting groove of the rotating magnetic cylinder, and the removable fixation of the holder is configured to be removably fixed to the circumferential mounting groove of the rotating magnetic cylinder of the printing unit, wherein the axis is substantially perpendicular to the bottom surface of the holder;

wherein the holder includes a lower recess between the accommodating recess and the bottom surface, at least a part of the motor is disposed in the lower recess of the holder, and the motor includes a central hole to provide access to the removable fixation.

* * * * *